US009483978B2

(12) United States Patent
Aoki

(10) Patent No.: US 9,483,978 B2
(45) Date of Patent: Nov. 1, 2016

(54) DISPLAY DEVICE AND METHOD OF DRIVING THE SAME

(71) Applicant: Sony Corporation, Tokyo (JP)

(72) Inventor: Takeshi Aoki, Kanagawa (JP)

(73) Assignee: JOLED Inc., Tokyo (JP)

( * ) Notice: Subject to any disclaimer, the term of this patent is extended or adjusted under 35 U.S.C. 154(b) by 355 days.

(21) Appl. No.: 14/073,548

(22) Filed: Nov. 6, 2013

(65) Prior Publication Data

US 2014/0132646 A1 May 15, 2014

(30) Foreign Application Priority Data

Nov. 13, 2012 (JP) ..... 2012-249074

(51) Int. Cl.
*G09G 5/10* (2006.01)
*G09G 3/32* (2016.01)

(52) U.S. Cl.
CPC .... *G09G 3/3233* (2013.01); *G09G 2300/0819* (2013.01); *G09G 2300/0842* (2013.01); *G09G 2300/0866* (2013.01); *G09G 2320/0261* (2013.01); *G09G 2320/064* (2013.01); *G09G 2330/021* (2013.01); *G09G 2360/16* (2013.01)

(58) Field of Classification Search
CPC ..... G09G 3/3233; G09G 3/2014; G09G 3/2074; G09G 3/2081; G09G 2300/0842; G09G 2320/0233; G09G 2320/0606; G09G 2320/0626; G09G 2320/0666; G09G 2330/021
USPC ..... 345/691, 76–89
See application file for complete search history.

(56) References Cited

U.S. PATENT DOCUMENTS

2002/0003522 A1* 1/2002 Baba ..... G09G 3/342 345/89
2006/0152452 A1* 7/2006 Hoppenbrouwers G09G 3/3233 345/77

FOREIGN PATENT DOCUMENTS

GB WO 2004049289 A1 * 6/2004 ..... G09G 3/3233
JP 2007-310311 A 11/2007
JP 2009-192753 8/2009
JP 2012-181353 9/2012

OTHER PUBLICATIONS

Official Action (with English translation) for Japanese Patent Application No. 2012-249074 mailed May 31, 2016, 7 pages.

* cited by examiner

*Primary Examiner* — Kent Chang
*Assistant Examiner* — Mark Edwards
(74) *Attorney, Agent, or Firm* — Sheridan Ross P.C.

(57) ABSTRACT

A display device includes a display unit having display elements arrayed in rows and columns. The display elements each include a current-driven light emitting unit and a drive circuit for driving the light emitting unit. A power supply unit supplies a drive voltage for driving the display elements to power supply lines corresponding to the rows of display elements. A signal output unit supplies video signal voltages to data lines corresponding to the columns of the display elements. A control unit detects maximum grayscale values of input signals corresponding to the display elements arranged in the rows, and accordingly controls duty ratios of the drive voltage supplied to the power supply lines corresponding to the rows of the display elements. The control unit also controls values of video signals corresponding to the display elements in each row.

4 Claims, 23 Drawing Sheets

[PERIOD A]

[PERIOD B]

[PERIOD C]

FIG. 13

| CONTENTS OF LUT | | |
|---|---|---|
| DUTY VALUES IN POWER SUPPLY LINES PS1 | VALUES OF INPUT SIGNALS $DT_{Sig}$ | VALUES OF VIDEO SIGNALS $VD_{Sig}$ |
| $D_1$ e.g. 45% | 0 | $Data(D_1, 0) = 0$ |
| | 1 | $Data(D_1, 1) = 1$ |
| | 2 | $Data(D_1, 2) = 2$ |
| | ⋮ | ⋮ |
| | 126 | $Data(D_1, 126) = 126$ |
| | 127 | $Data(D_1, 127) = 127$ |
| $D_2$ e.g. 90% | 0 | $Data(D_2, 0)$ |
| | 1 | $Data(D_2, 1)$ |
| | 2 | $Data(D_2, 2)$ |
| | ⋮ | ⋮ |
| | 127 | $Data(D_2, 127)$ |
| | 128 | $Data(D_2, 128)$ |
| | ⋮ | ⋮ |
| | 254 | $Data(D_2, 254)$ |
| | 255 | $Data(D_2, 255)$ |

FIG. 16

| CONTENTS OF LUT | | |
|---|---|---|
| DUTY VALUES IN POWER SUPPLY LINES PS1 | VALUES OF INPUT SIGNALS $DT_{Sig}$ | VALUES OF VIDEO SIGNALS $VD_{Sig}$ |
| $D_1$ e.g. 45% | 0 | Data($D_1$, 0) = 0 |
| | 1 | Data($D_1$, 1) = 1 |
| | 2 | Data($D_1$, 2) = 2 |
| | ⋮ | ⋮ |
| | 126 | Data($D_1$, 126) = 126 |
| | 127 | Data($D_1$, 127) = 127 |
| $D_2$ e.g. 90% | 0 | Data($D_2$, 0) |
| | 1 | Data($D_2$, 1) |
| | 2 | Data($D_2$, 2) |
| | ⋮ | ⋮ |
| | 254 | Data($D_2$, 254) |
| | 255 | Data($D_2$, 255) |
| $D_3$ e.g. 75% | 0 | Data($D_3$, 0) |
| | 1 | Data($D_3$, 1) |
| | 2 | Data($D_3$, 2) |
| | ⋮ | ⋮ |
| | 126 | Data($D_3$, 126) |
| | 127 | Data($D_3$, 127) |
| $D_4$ e.g. 60% | 0 | Data($D_4$, 0) |
| | 1 | Data($D_4$, 1) |
| | 2 | Data($D_4$, 2) |
| | ⋮ | ⋮ |
| | 126 | Data($D_4$, 126) |
| | 127 | Data($D_4$, 127) |

DISPLAY DEVICE AND METHOD OF DRIVING THE SAME

CROSS REFERENCE TO RELATED APPLICATIONS

This application claims the benefit of Japanese Priority Patent Application JP 2012-249074 filed Nov. 13, 2012, the entire contents of which are incorporated herein by reference.

BACKGROUND

The present disclosure relates to a display device and a method of driving the display device.

Display elements including current-driven light emitting units and display devices including such display elements are well recognized. For example, display elements including light emitting units making use of the electroluminescence of organic materials (which may be referred to hereinafter simply as organic EL display elements) are attracting attention as the display elements that can be driven by low-voltage direct current and emit high luminance light.

The simple matrix scheme and the active matrix scheme are well recognized as the schemes for driving display devices including organic EL display elements, for example, similarly to liquid crystal display devices. Although it disadvantageously entails a complicated structure, the active matrix system can advantageously enhance the luminance of images, for example. Organic EL display elements driven by the active matrix scheme each include a light emitting unit configured with, for example, organic layers including a light emitting layer, and a drive circuit for driving the light emitting unit.

A drive circuit including two transistors and one capacitor (referred to as 2Tr/1C drive circuit), for example, is well recognized as a circuit for driving a current-driven light emitting unit from Japanese Unexamined Patent Application Publication No. 2007-310311 and other documents. The 2Tr/1C drive circuit is configured with two transistors, i.e., a write transistor $TR_W$ and a drive transistor $TR_D$, and one capacitor $C_1$, for example, as shown in FIG. 3 which will be described later.

SUMMARY

The luminance of a display device including display elements configured as shown in FIG. 3 basically depends on the value of the current flowing into each light emitting unit and its duty ratio, i.e., the ratio of the time length in which the current is flowing into the light emitting unit to one field period. A small duty ratio is preferable to reduce blurs of moving images, but it shortens the light emitting period of the light emitting unit and accordingly reduces the luminance of the display device. In such a situation, to enhance the luminance of the displayed image, it is necessary to set the drive voltage for driving the display elements to a higher value. This will increase the power consumption of the display device.

It is desirable to provide a display device and a method of driving the display device that can reduce blurs of moving images and enhance the luminance of the images without having to set the drive voltage to a higher value.

A display device according to an embodiment of the present disclosure includes a display unit including display elements arrayed in rows and columns of a two-dimensional matrix, the display elements each including a current-driven light emitting unit and a drive circuit for driving the light emitting unit, a power supply unit for supplying a drive voltage for driving the display elements to power supply lines provided in correspondence with the rows of the display elements, a signal output unit for supplying video signal voltages dependent on video signal values to data lines provided in correspondence with the columns of the display elements, and a control unit for detecting maximum grayscale values of the input signals corresponding to the display elements arranged in rows on the basis of input signals for an image to be displayed, controlling duty ratios of the drive voltage supplied to the power supply lines corresponding to the display elements on the basis of the detection results, and controlling values of the video signals corresponding to the display elements in each row on the basis of the duty ratios of the drive voltage and the input signals.

A method of driving a display device according to an embodiment of the present disclosure, the display device including a display unit including display elements arrayed in rows and columns of a two-dimensional matrix, the display elements each including a current-driven light emitting unit and a drive circuit for driving the light emitting unit, a power supply unit for supplying a drive voltage for driving the display elements to power supply lines provided in correspondence with the rows of the display elements, a signal output unit for supplying video signal voltages dependent on video signals to data lines provided in correspondence with the columns of the display elements, and a control unit for controlling duty ratios of the drive voltage supplied to the power supply lines corresponding to the display elements and the values of video signals corresponding to the display elements, includes detecting maximum grayscale values of the input signals corresponding to the display elements arranged in rows on the basis of the input signals for an image to be displayed, controlling, on the basis of the detection results, duty ratios of the drive voltage supplied to the power supply lines corresponding to the display elements, and controlling the values of the video signals corresponding to the display elements in each row on the basis of the duty ratios of the drive voltage and the input signals.

In the display device and the method of driving the display device according to an embodiment of the present disclosure, maximum grayscale values of the input signals corresponding to the display elements arranged in rows are detected on the basis of the input signals for an image to be displayed, the duty ratios of the drive voltage supplied to power supply lines corresponding to the display elements are controlled on the basis of the detection results, and the values of the video signals corresponding to the display elements in each row are controlled on the basis of the duty ratios of the drive voltage and the input signals. With this, blurs of moving images can be reduced and the luminance of the images can be enhanced without having to set the drive voltage to a higher value.

BRIEF DESCRIPTION OF THE DRAWINGS

FIG. 13 is a schematic table illustrating the data stored in a video signal value table storage unit;

FIG. 16 is a schematic table illustrating the data stored in the video signal value table storage unit;

DETAILED DESCRIPTION OF EMBODIMENTS

Figure 1:
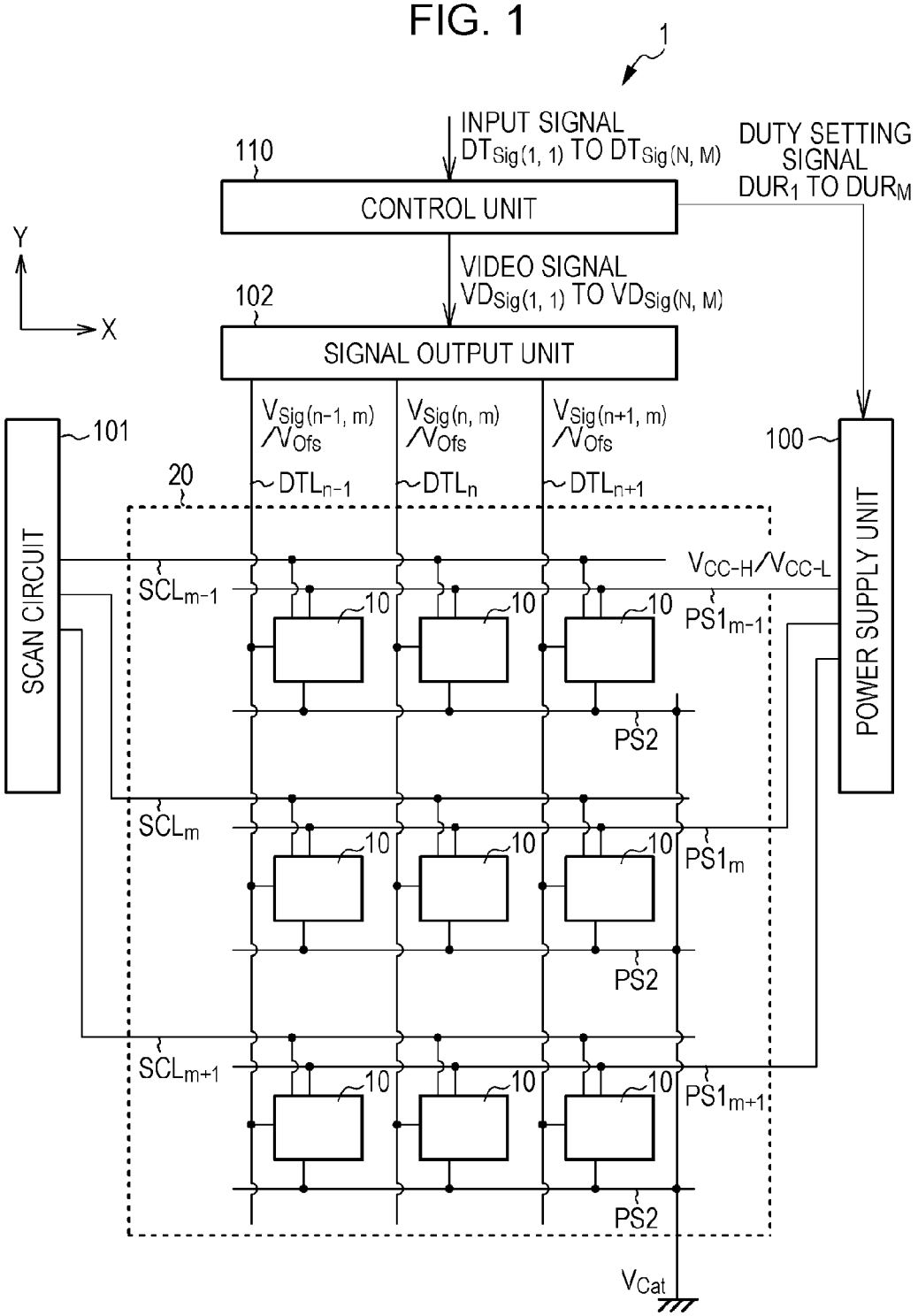
FIG. 1 is a conceptual diagram of a display device according to an embodiment.

Referring now to the drawings, an embodiment of the present disclosure will be described. The present disclosure is not limited to this embodiment; various numerical values and materials in this embodiment are merely illustrative. In the following description, like elements or elements having like functions will be denoted by like reference characters and duplicate description thereof will be omitted. Description will be given in the following order:

1. General description of a display device and a method of driving the display device according to a present disclosure
2. An embodiment and others.

General Description of Display Device and Method of Driving Display Device According to a Present Disclosure A display device or a method of driving the display device, which will be referred to hereinafter simply as the present disclosure where appropriate, can be configured such that the video signal values corresponding to the duty ratio values of a drive voltage and the input signal values are set so as to compensate for an influence of the length of time elapsed before a light emitting unit starts emitting light that varies with the value of the current flowing into the light emitting unit.

In an embodiment of the present disclosure including the preferred configuration described above, the control unit can include a video signal value table storage unit storing values of video signals corresponding to the duty ratio values of a drive voltage and the input signal values.

In this embodiment of the present disclosure including the preferred configuration described above, the control unit can be configured so as to set the duty ratios of the drive voltage to a predetermined value $D_1$ when the maximum grayscale value is equal to or less than a predetermined reference value or to a predetermined value $D_2$ greater than the value $D_1$ when the maximum grayscale value exceeds the predetermined reference value. In this situation, if the vicinity of the row having the maximum grayscale value exceeding the predetermined reference value is occupied by rows having the maximum grayscale values not exceeding the predetermined reference value, the control unit can control the duty ratios of the drive voltage in the rows adjacent to the row having the maximum grayscale value exceeding the predetermined reference value such that the duty ratios in the adjacent rows closer to the row having the maximum grayscale value exceeding the predetermined reference value become closer to the predetermined value $D_2$ and control the video signal values corresponding to the display elements.

The power supply unit, signal output unit, and control unit used in this embodiment of the present disclosure including the preferred configurations described above may be configured using well-recognized circuit elements, for example.

The display device may be configured as the so-called monochrome display device or a color display device. In the color display device, a single pixel may be configured with a plurality of sub-pixels; specifically, a single pixel may be made up of three sub-pixels, including a red light emitting sub-pixel, a green light emitting sub-pixel, and a blue light emitting sub-pixel. Furthermore, a single pixel may be configured with one set of sub-pixels, including, in addition to these three sub-pixels, one or more different sub-pixels (e.g., a white-light emitting sub-pixel to improve the luminance, a complementary-color light emitting sub-pixel to enlarge the color reproduction range, a yellow-light emitting sub-pixel to enlarge the color reproduction range, or yellow- and cyan-light emitting sub-pixels to enlarge the color reproduction range).

The pixel values in the display device may include, but are not limited to, values for image display resolution such as VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536), as well as (1920, 1035), (720, 480), and (1280, 960).

The current-driven light emitting unit forming part of the display element may be an organic electroluminescence light emitting unit, LED light emitting unit, or semiconductor laser light emitting unit, for example. These light emitting units can be configured using well-recognized materials and methods. To build a flat-panel display device, the light emitting unit is preferably an organic electroluminescence light emitting unit.

The display element of the display unit is formed in a plane (formed on a support, for example) and the light emitting unit is formed above the drive circuit for driving the light emitting unit, with an interlayer insulating layer in between.

The drive circuit for driving the light emitting unit can be configured as a circuit including transistors and a capacitor, for example. The transistors forming part of the drive circuit may be n-channel thin film transistors (TFTs), for example. The transistors may be of the enhancement type or depletion type. In the n-channel transistor, a lightly doped drain (LDD) structure may be formed. In some cases, the LDD structure may be formed asymmetrically. For example, since a large current flows through the drive transistor when the display element emits light, the LDD structure may be formed in one source/drain region that serves as the drain region at the time of light emission. P-channel thin film transistors may be used instead, for example. The configuration of the drive circuit is not limited to any particular configuration as long as it is suitable for the operation of the present disclosure.

In one transistor having two source/drain regions, the term "one source/drain region" may sometimes refer to the source/drain region connected to the power supply side. The conductive state of the transistor refers to a state in which a channel is formed between the source/drain regions. It does not matter whether current flows or not from one source/drain region to the other source/drain region of this transistor. On the other hand, the non-conductive state of the transistor refers to a state in which a channel is not formed between the source/drain regions. The source/drain regions may be configured not only from an impurity-doped polysilicon, amorphous silicon, or another conductive material, but also from metal, alloy, conductive particles, or a layered structure thereof, or a layer formed from an organic material (conductive polymer).

The capacitor forming part of the drive circuit may be configured with one electrode, the other electrode, and a dielectric layer between these electrodes. These transistors and capacitor of the drive circuit are formed in a plane (on a support, for example), while the light emitting unit is formed above the transistors and capacitor of the drive circuit with an interlayer insulating layer in between, for example. The other source/drain region of the drive transistor is connected to an end of the light emitting unit (e.g., to an anode electrode provided in the light emitting unit) through a contact hole, for example. The transistors may be formed on a semiconductor substrate or the like.

Various wirings for scan lines, data lines, power supply lines, etc. are formed in a plane (on a support, for example). These wirings can be of well-recognized configurations and structures.

Exemplary materials for the support and the substrate described below may include high strain point glass, soda glass ($Na_2O.CaO.SiO_2$), borosilicate glass ($Na_2O.B_2O_3.SiO_2$), forsterite ($2MgO.SiO_2$), lead glass ($Na_2O.PbO.SiO_2$), or other glass materials, as well as flexible polymeric materials such as polyethersulfone (PES), polyimide, polycarbonate (PC), and polyethylene terephthalate (PET). The surfaces of the support and substrate may be covered with various coatings. The materials of the support and the substrate may be identical or different. If flexible polymeric materials are used for the support and substrate, a flexible display device can be obtained.

The conditions indicated in various formulae in the present description are satisfied not only when the formulae are established with mathematical precision, but also when the formulae are virtually established. For establishment of the formulae, the presence of variations in design or manufacture of the display elements or display device is permitted.

In the timing charts that are referred to in the following description, the length of the horizontal axis indicating each time period (time length) is approximate and does not indicate the proportion of the length of time of each period. The same applies to the vertical axis. The shapes of the waveforms in the timing charts are schematic.

Embodiment and Others

An embodiment relates to an innovative display device and an innovative method of driving the display device.

FIG. 1 is a conceptual diagram of a display device according to this embodiment.

A display device 1 includes a display unit 20 having display elements 10 arrayed in rows and columns of a two-dimensional matrix, the display elements 10 each including a current-driven light emitting unit and a drive circuit for driving the light emitting unit; a power supply unit 100 for supplying a drive voltage $V_{CC-H}$ for driving the display elements 10 to power supply lines PS1 provided in correspondence with the rows of display elements 10; a signal output unit 102 for supplying video signal voltages $V_{Sig}$ dependent on the values of video signals $VD_{Sig}$ to data lines DTL provided in correspondence with the columns of display element 10; and, a control unit 110 for controlling the duty ratios of the drive voltage $V_{CC-H}$ supplied to the power supply lines PS1 corresponding to the display elements 10 and the values of the video signals $VD_{Sig}$ corresponding to the display elements 10.

The control unit 110 detects the maximum grayscale values of the input signals $DT_{Sig}$ corresponding to the display elements 10 arranged in rows on the basis of the input signals $DT_{Sig}$ for an image to be displayed. Then, on the basis of the result of this detection, the control unit 110 controls the duty ratios of the drive voltage $V_{CC-H}$ supplied to the power supply lines PS1 corresponding to the display elements 10, and on the basis of the duty ratios of the drive voltage $V_{CC-H}$ and the input signals $DT_{Sig}$, controls the values of the video signals $VD_{Sig}$ corresponding to the display elements in each row. In this embodiment, the control unit 110 detects the maximum grayscale values of the input signals $DT_{Sig}$ corresponding to the display elements 10 arranged in rows on the basis of the input signals $DT_{Sig}$ for an image to be displayed, then, on the basis of the result of this detection, controls the duty ratios of the drive voltage supplied to the power supply lines PS1 corresponding to the display elements 10, and, on the basis of the duty ratios of the drive voltage and the input signals $DT_{Sig}$, controls the values of the video signals $VD_{Sig}$ corresponding to the display elements 10 in each row.

The display unit 20 also includes scan lines SCL connected to the display elements 10 arranged in rows and supplied with scan signals from a scan circuit 101, as well as a second power supply line PS2 connected in common to all the display elements 10. The second power supply line PS2 is supplied with a common voltage $V_{Cat}$ which will be described later.

The connections of the scan lines SCL, data lines DTL, power supply lines PS1, and second power supply line PS2 to the display elements 10 will be described later in detail with reference to FIG. 3.

The region in which an image is displayed by the display unit 20 (display region) is formed by a two-dimensional matrix of display elements 10 arrayed in N rows (X direction in FIG. 1) by M columns (Y direction FIG. 1). In this display region, the number of rows of display elements 10 is M and the number of display elements 10 in each row is N. The configuration of 3×3 display elements 10 in FIG. 1 is merely illustrative.

The number of scan lines SCL and the number of power supply lines PS1 are M, respectively. The display elements 10 in the m-th row (m=1, 2, . . . , M) are connected to the m-th scan line $SCL_m$ and the m-th power supply line $PS1_m$ and form one display element row.

The number of data lines DTL is N. The display elements 10 in the n-th column (n=1, 2, . . . , N) are connected to the n-th data line $DTL_n$.

The display device 1 is a monochrome display device, for example, in which one display element 10 forms one pixel. In the display device 1, line sequential scanning is performed row by row in response to scan signals from the scan circuit 101. The display element 10 located in the m-th row and the n-th column will be referred to hereinafter as the (n,m)-th display element 10 or (n,m)-th pixel.

In the display device 1, the display elements 10 forming the N pixels in the m-th row are driven at the same time. In other words, the light emitting time of the N display elements 10 arranged in rows is controlled row by row. When line sequential scanning is performed row by row in the display device 1, the scan period per row (i.e., horizontal scan period) is less then (1/FR)×(1/M) seconds, where FR (times/second) is the display frame rate in the display device 1.

The control unit 110 in the display device 1 receives input signals $DT_{Sig}$ dependent on the images to be displayed from a device (not shown), for example. On the basis of the input signals $DT_{Sig}$, the control unit 110 outputs video signals $VD_{Sig}$ and duty setting signals DUR for controlling the operation of the power supply unit 100.

The signal output unit 102 outputs video signal voltages $V_{Sig}$ on the basis of the video signals $VD_{Sig}$. More specifically, the signal output unit 102 alternately supplies the video signal voltages $V_{Sig}$ and a reference voltage $V_{Ofs}$, which will be described later, to the data lines DTL.

In the following description, an input signal $DT_{Sig}$ corresponding to the (n,m)-th display element 10, for example, will be referred to hereinafter as the input signal $DT_{Sig(n,m)}$ where appropriate. The same applies to the video signal $VD_{Sig}$.

A video signal voltage $V_{Sig}$ corresponding to the (n,m)-th display element 10, for example, will be referred to hereinafter as the video signal voltage $V_{Sig(n,m)}$ or video signal voltage $V_{Sig_m}$ where appropriate.

The power supply unit 100 supplies, in addition to the drive voltage $V_{CC-H}$ described above, an initialization voltage $V_{CC-L}$, which will be described later, to the power supply lines PS1. The ratio of the duration of supply of the drive voltage $V_{CC-H}$ to one frame period (referred to hereinafter as the "duty ratio of the drive voltage" where appropriate) is controlled for each power supply line PS1 by a duty setting signal DUR from the control unit 110. In the following description, the duty setting signal for the m-th power supply line $PS1_m$ will be referred to as the duty setting signal $DUR_m$ where appropriate.

For illustrative purpose, the number of grayscale bits of the input signal $DT_{Sig}$ and video signal $VD_{Sig}$ is eight. The grayscale value of the input signal $DT_{Sig}$ is any one of the values in the range of 0 to 255 depending on the luminance of the image to be displayed. Here, it is assumed that the higher the grayscale value of the input signal $DT_{Sig}$ is, the higher the luminance of the image to be displayed is.

For illustrative purpose, the display device 1 is configured such that, as the grayscale value changes from 0 to 255 in the white-displaying state, the luminance linearly changes from 0 [cd/m$^2$] to a predetermined maximum value (1000 [cd/m$^2$], for example).

Next, the configuration and operation of the control unit 110 will be generally described.

Figure 2:
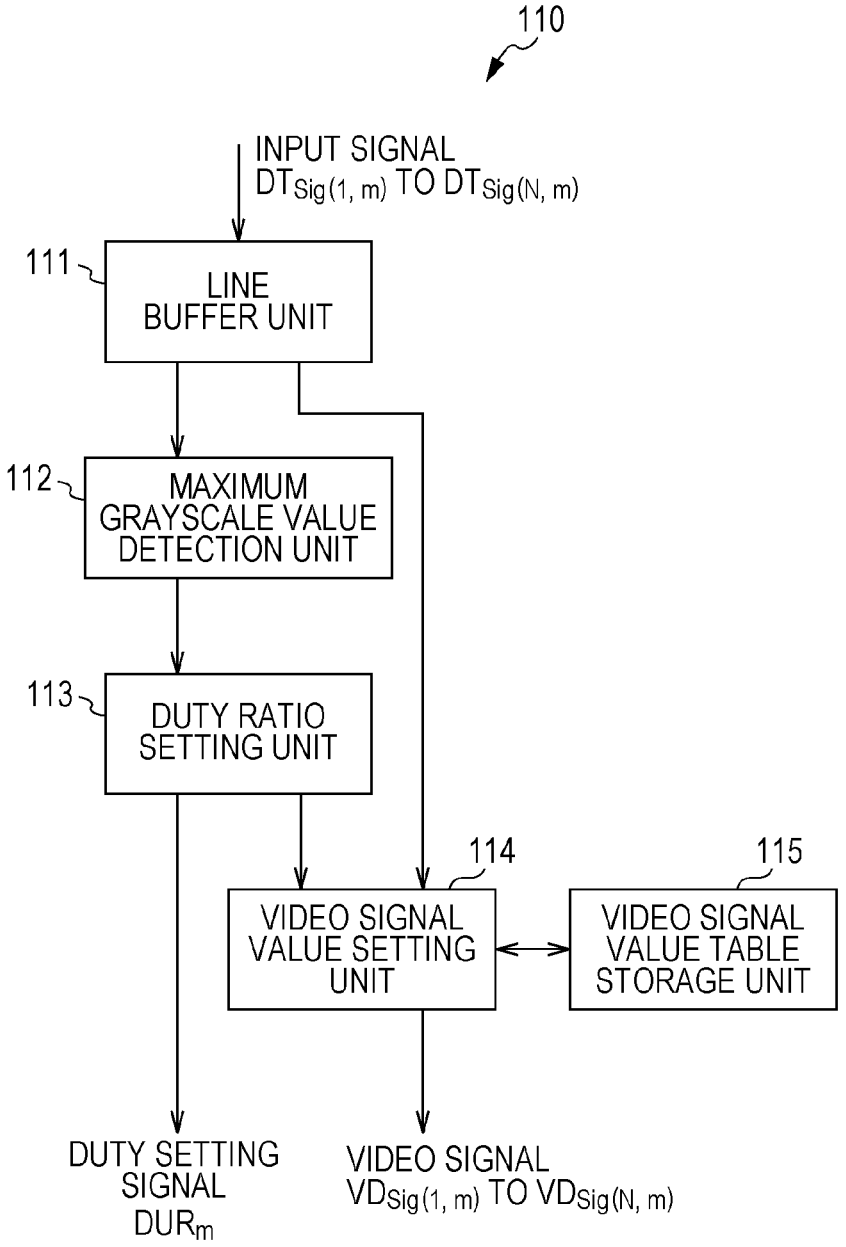
FIG. 2 is a schematic block diagram illustrating the configuration and operation of the control unit.

FIG. 2 is a schematic block diagram illustrating the configuration and operation of the control unit.

The control unit 110 includes a line buffer unit 111, maximum grayscale value detection unit 112, duty ratio setting unit 113, video signal value setting unit 114, and video signal value table storage unit 115.

The control unit 110 detects the maximum grayscale values of the input signals $DT_{Sig}$ corresponding to the display elements 10 arranged in rows on the basis of the input signals $DT_{Sig}$ for an image to be displayed, then, on the basis of the result of this detection, controls the duty ratios of the drive voltage supplied to the power supply lines PS1 corresponding to the display elements 10, and, on the basis of the duty ratios of the drive voltage and the input signals $DT_{Sig}$, controls the values of the video signals $VD_{Sig}$ corresponding to the display elements 10 in each row.

The control unit 110 sequentially performs processing on the display elements 10 row by row. Referring now to FIG. 2, processing on the display elements 10 in the m-th row will be described.

Input signals $DT_{Sig(1,m)}$ to $DT_{Sig(N,m)}$ input to the control unit 110 are held in the line buffer unit 111. The maximum grayscale value detection unit 112 detects the maximum grayscale value in the input signals $DT_{Sig(1,m)}$ to $DT_{Sig(N,m)}$ on the basis of the values held in the line buffer unit 111.

The control unit 110 sets the duty ratios of the drive voltage to a predetermined value $D_1$ when the maximum grayscale value is equal to or less than a predetermined reference value (127, for example), or to a predetermined value $D_2$ greater than the value $D_1$ when the maximum grayscale value exceeds the predetermined reference value.

Specifically, the duty ratio setting unit 113 sets the duty ratio of the drive voltage to be supplied to the power supply line $PS1_m$ corresponding to the display elements in the m-th row on the basis of the detection result of the maximum grayscale value detection unit 112. The duty ratio of the drive voltage in the power supply line $PS1_m$ is set to a predetermined value $D_1$ (e.g. 45[%]) when the detection result is equal to or less than "127", or to a predetermined value $D_2$ (e.g. 90[%]) when the detection result is equal to or more than "128".

The duty ratio setting unit 113 supplies to the power supply unit 100 a duty setting signal $DUR_m$ for controlling the duty ratio of the drive voltage in the power supply line $PS1_m$.

The video signal value setting unit 114 controls the value of the video signal $VD_{Sig}$ corresponding to the display elements 10 in each row by setting the values of the video signals $VD_{Sig}$ on the basis of the duty ratio of the drive voltage set by the duty ratio setting unit 113 and the values of the input signals $DT_{Sig}$ held in the line buffer unit 111.

In the video signal value table storage unit 115, there are held, in the form of a table, values of the video signals $VD_{Sig}$ corresponding to the values of the duty ratios of the drive voltage and the values of the input signals $DT_{Sig}$. The video signal value setting unit 114 sets video signals $VD_{Sig(1,m)}$ to $VD_{Sig(N,m)}$ by sequentially referencing the video signal value table storage unit 115 and supplies these signals to the signal output unit 102. The contents of the table will be described later in detail with reference to FIG. 13.

The signal output unit 102 supplies video signal voltages $V_{Sig}$ dependent on the values of the video signals $VD_{Sig}$ to the data lines DTL. The correspondence between the values of the video signals $VD_{Sig}$ and the values of the video signal voltages $V_{Sig}$ is preset such that the luminance and the values of the video signals $VD_{Sig}$ exhibit linearity when current flows through the light emitting units.

The configuration and operation of the control unit 110 has been generally described above. Here, to help understand the present disclosure, the configuration and operation of a display element 10 and the basic operation of the display device 1 will be generally described.

Figure 3:
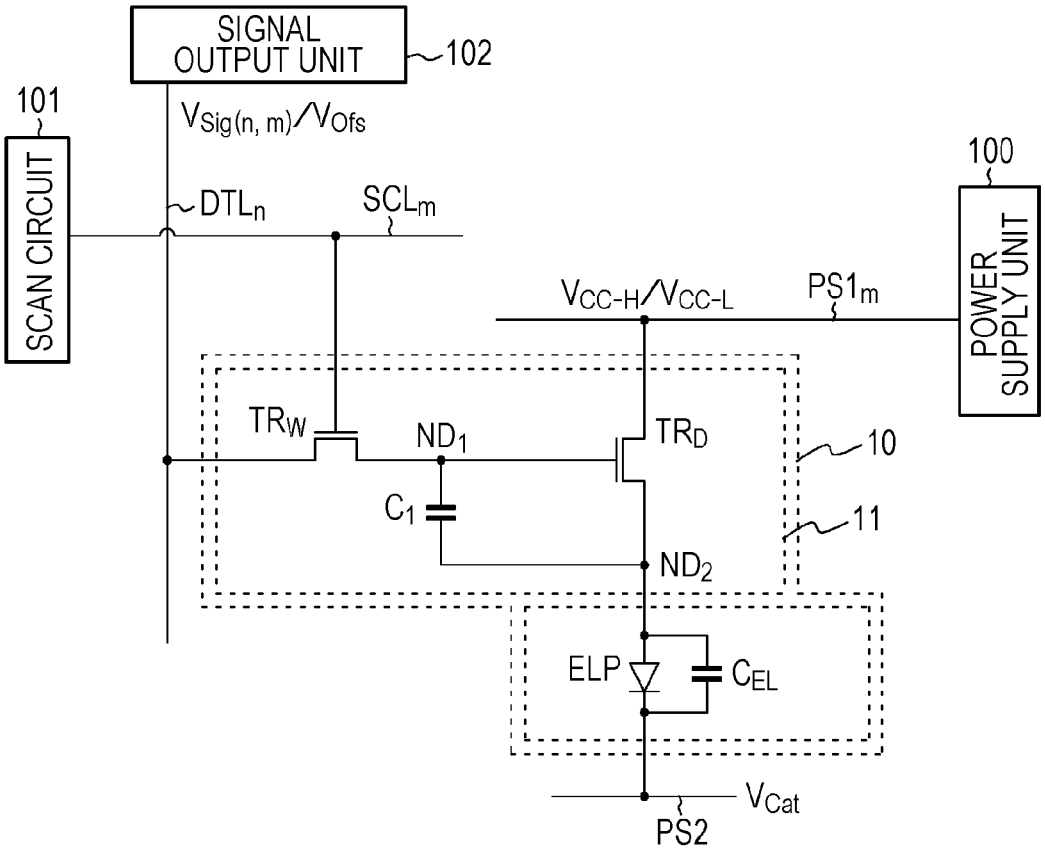
FIG. 3 is an equivalent circuit diagram of the (m,n)-th display element.

FIG. 3 is an equivalent circuit diagram of the (m,n)-th display element.

The display element 10 includes a current-driven light emitting unit ELP and a drive circuit 11. The drive circuit 11 includes a drive transistor $TR_D$ and a capacitor $C_1$ and current flows through the source/drain region of the drive transistor $TR_D$ into the light emitting unit ELP.

The drive circuit 11 further includes, in addition to the drive transistor $TR_D$, a write transistor $TR_W$. The drive transistor $TR_D$ and the write transistor $TR_W$ are formed from n-channel TFTs. Alternatively, the write transistor $TR_W$ may be formed from a p-channel TFT, for example. The drive circuit 11 may further include another transistor.

The capacitor $C_1$ is used to keep a voltage of the gate electrode with respect to the source region of the drive transistor $TR_D$ (so-called gate-source voltage). Here, the "source region" refers to the source/drain region that serves as the "source region" when the light emitting unit ELP emits light. In the state in which the display element 10 is emitting light, one source/drain region of the drive transistor $TR_D$ (the side connected to the power supply line PS1 in FIG. 2) serves as the drain region, while the other source/drain region (the side connected to an end, i.e., the anode electrode, of the light emitting unit ELP) serves as the source region. One and the other electrodes of the capacitor $C_1$ are connected to the other source/drain region and the gate electrode of the drive transistor $TR_D$, respectively.

The write transistor $TR_W$ has a gate electrode connected to the scan line SCL, one source/drain region connected to the data line DTL, and the other source/drain region connected to the gate electrode of the drive transistor $TR_D$.

The gate electrode of the drive transistor $TR_D$ forms a first node $ND_1$ to which the other source/drain region of the write transistor $TR_W$ and the other electrode of the capacitor $C_1$ are connected. The other source/drain region of the drive transistor $TR_D$ forms a second node $ND_2$ to which the one electrode of the capacitor $C_1$ and the anode electrode of the light emitting unit ELP are connected.

A voltage $V_{Cat}$ (e.g., 0 volts) is applied from the second power supply line PS2 to the other end (specifically, cathode electrode) of the light emitting unit ELP. The capacitance of the light emitting unit ELP is denoted by reference character $C_{EL}$. The threshold voltage necessary for the light emitting unit ELP to emit light is denoted by reference character $V_{th\text{-}EL}$. That is, when a voltage equal to or more than $V_{th\text{-}EL}$ is applied between the anode electrode and the cathode electrode of the light emitting unit ELP, the light emitting unit ELP emits light.

The light emitting unit ELP includes an organic electroluminescence light emitting unit, for example, and has a well-recognized configuration and structure including an anode electrode, hole transport layer, light emitting layer, electron transport layer, and cathode electrode.

Figure 4:
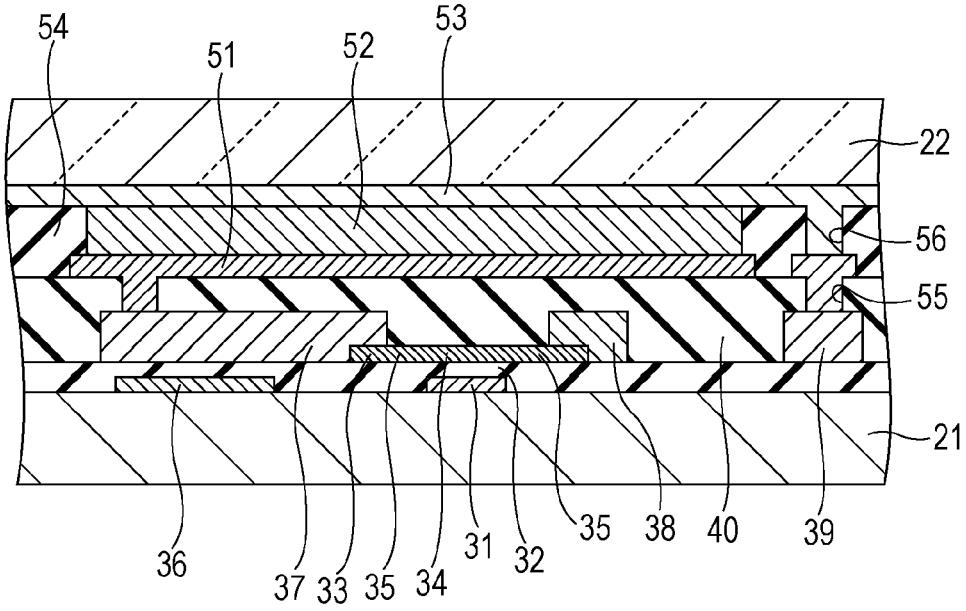
FIG. 4 is a schematic partial sectional view of a portion of the display unit including a display element.

FIG. 4 is a schematic partial sectional view of a portion of the display unit including a display element.

The transistors $TR_D$, $TR_W$ and capacitor $C_1$ of the drive circuit 11 are formed on a support 21, while the light emitting unit ELP is formed above the transistors $TR_D$, $TR_W$, and capacitor $C_1$ of the drive circuit 11 with an interlayer insulating layer 40 in between, for example. The other source/drain region of the drive transistor $TR_D$ is connected through a contact hole to the anode electrode provided in the light emitting unit ELP. Only the drive transistor $TR_D$ is shown in FIG. 4. The other transistors are hidden and invisible.

The drive transistor $TR_D$ is configured with a gate electrode 31, gate insulating layer 32, source/drain regions 35, 35 provided in a semiconductor layer 33, and a channel forming region 34 corresponding to a portion of the semiconductor layer 33 between the source/drain regions 35, 35. The capacitor $C_1$ is configured with the other electrode 36, a dielectric layer formed from an extension of the gate insulating layer 32, and one electrode 37. The gate electrode 31, a portion of the gate insulating layer 32, and the other electrode 36 of the capacitor $C_1$ are formed on the support 21. One source/drain region 35 of the drive transistor $TR_D$ is connected to a wiring 38 (corresponding to the power supply line PS1), while the other source/drain region 35 is connected to the one electrode 37. The drive transistor $TR_D$, capacitor $C_1$, etc. are covered by the interlayer insulating layer 40, above which the light emitting unit ELP including the anode electrode 51, hole transport layer, light emitting layer, electron transport layer, and cathode electrode 53 is provided. In this figure, the hole transport layer, light emitting layer, and electron transport layer are shown as a single layer 52. A second interlayer insulating layer 54 is provided on the portion of the interlayer insulating layer 40 on which the light emitting unit ELP is not provided. A transparent substrate 22 is provided on the second interlayer insulating layer 54 and cathode electrode 53 and transmits the light emitted by the light emitting layer to the outside. The one electrode 37 and the anode electrode 51 are connected to each other through a contact hole provided in the interlayer insulating layer 40. The cathode electrode 53 is connected, through contact holes 56, 55 provided in the second interlayer insulating layer 54 and interlayer insulating layer 40, to the wiring 39 (corresponding to the second power supply line PS2) provided on the extension of the gate insulating layer 32.

The drive transistor $TR_D$ shown in FIG. 3 has a voltage setting such that it operates in the saturation region when the display element 10 is in the light emitting state, and is driven such that drain current $I_{ds}$ flows according to formula (1) below. As described above, when the display element 10 is in the light emitting state, the one source/drain region of the drive transistor $TR_D$ serves as the drain region and the other source/drain region serves as the source region. For illustrative purpose, the one source/drain region of the drive transistor $TR_D$ will be referred to simply as the drain region, while the other source/drain region will be referred to simply as the source region, where appropriate. Formula (1) below is established, where, μ: effective mobility, L: channel length, W: channel width, $V_{gs}$: gate electrode voltage with respect to source region, $V_{th}$: threshold voltage, $C_{ox}$: (relative dielectric constant of gate insulating layer)× (dielectric constant of vacuum)/(thickness of gate insulating layer), and $k \equiv (1/2)\cdot(W/L)\cdot C_{ox}$.

$$I_{ds}=k\cdot\mu\cdot(V_{gs}-V_{th})^2 \quad (1)$$

When this drain current $I_{ds}$ flows into the light emitting unit ELP, the light emitting unit ELP in the display element 10 emits light. Furthermore, the magnitude of the value of this drain current $I_{ds}$ flowing into the light emitting unit ELP controls the light intensity in the light emitting unit ELP.

The configuration and operation of the display element 10 has been generally described above. Next, basic operations of the display device 1 will generally be described. Details of the operations will be described later with reference to FIGS. 17A to 22.

Figure 5:
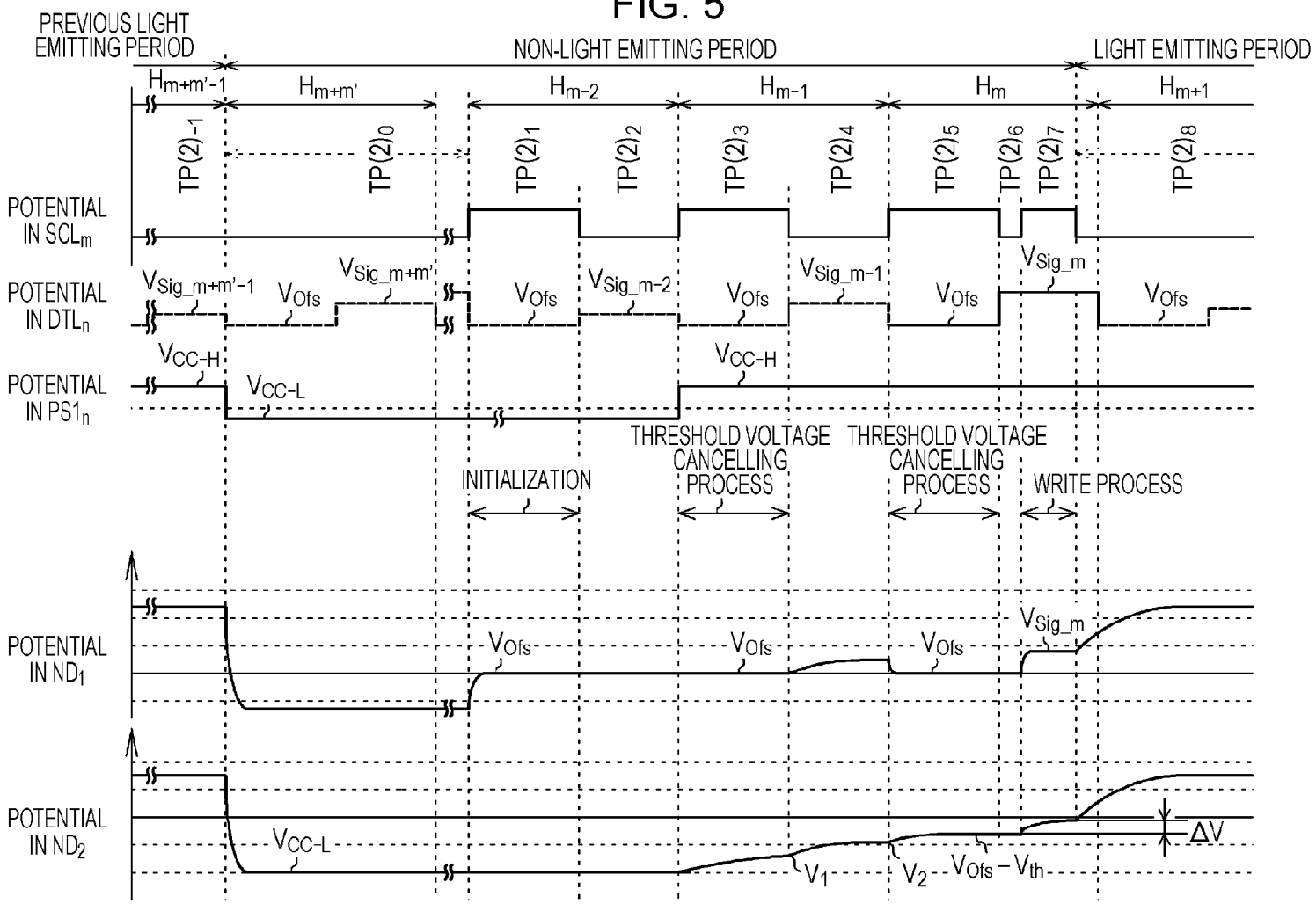
FIG. 5 a schematic timing chart illustrating the operation of the display device.

FIG. 5 a schematic timing chart illustrating the operations of the display device.

In the following description, the voltage or potential values below will be used for illustrative purpose, although the present disclosure is not limited to these values.

$V_{Sig}$ (video signal voltage): 0-15 volts $V_{Ofs}$ (reference voltage applied to the gate electrode (first node $ND_1$) of the drive transistor $TR_D$): 0 volts $V_{CC\text{-}H}$ (drive voltage for applying current to the light emitting unit ELP): 20 volts $V_{CC\text{-}L}$ (initialization voltage for initializing the potential of the other source/drain region (second node $ND_2$) of the drive transistor $TR_D$): −10 volts $V_{th}$ (threshold voltage of the drive transistor $TR_D$): 3 volts $V_{Cat}$ (voltage applied to the cathode electrode of the light emitting unit ELP): 0 volts $V_{th\text{-}EL}$ (threshold voltage of the light emitting unit ELP): 4 volts In FIG. 5, time period $[TP(2)_{-1}]$ indicates the operation in the previous display frame, for example, in which the (n,m)-th display element 10 is in the light emitting state. That is, drain current $I_{ds}$ is flowing through the drive transistor into the light emitting unit ELP in the display element 10 forming the (n,m)-th pixel. The light emitting state of the (n,m)-th display element 10 continues until immediately before the beginning of the horizontal scan period of the display elements 10 in the (m+m') row.

At the beginning of time period $[TP(2)_0]$, the voltage in the power supply line $PS1_m$ is changed from the drive voltage $V_{CC\text{-}H}$ to the initialization voltage $V_{CC\text{-}L}$ and this state continues until the end of time period $[TP(2)_2]$. The (n,m)-th display element 10 is in non-light emitting state.

In time period $[TP(2)_1]$, the potential at the gate electrode of the drive transistor $TR_D$ and the potential in the other source/drain region of the drive transistor $TR_D$ are initialized by applying the initialization voltage $V_{CC\text{-}L}$ of which the difference from the reference voltage $V_{Ofs}$ exceeds the threshold voltage of the drive transistor $TR_D$, from the power supply line $PS1_m$ to the one source/drain region of the drive transistor $TR_D$ and applying the reference voltage $V_{Ofs}$ from the data line $DTL_n$ to the gate electrode of the drive transistor $TR_D$ through the write transistor $TR_W$ that is determined to be in the conductive state on the basis of the scan signal from the scan line $SCL_m$.

At the beginning of time period $[TP(2)_3]$, the voltage in the power supply line $PS1_m$ is changed from the reference voltage $V_{Ofs}$ to the drive voltage $V_{CC\text{-}H}$.

In time periods $[TP(2)_3]$ and $[TP(2)_5]$, a threshold voltage cancelling process is performed to bring the potential in the other source/drain region of the drive transistor $TR_D$ toward the potential of the reference voltage $V_{Ofs}$ minus the threshold voltage of the drive transistor $TR_D$ by applying the drive voltage $V_{CC\text{-}H}$ from the power supply line $PS1_m$ to the one source/drain region of the drive transistor $TR_D$ while applying the reference voltage $V_{Ofs}$ from the data line $DTL_n$ to the gate electrode of the drive transistor $TR_D$ through the write transistor $TR_W$ that is determined to be in the conductive state on the basis of the scan signal from the scan line SCL.

In time period $[TP(2)_7]$, the write transistor $TR_W$ in the display element 10 is brought into a conductive state on the basis of the scan signal on the scan line $SCL_n$. A video signal voltage $V_{Sig_m}$ is applied from the data line $DTL_n$ to the gate electrode of the write transistor $TR_W$.

In the state in which the drive voltage $V_{CC\text{-}H}$ is being applied from the power supply unit 100 to the one source/drain region of the drive transistor $TR_D$, a video signal voltage $V_{Sig}$ is applied to the gate electrode of the drive transistor $TR_D$. This changes the potential in the second node $ND_2$ in the display element 10 in time period $[TP(2)_7]$ as shown in FIG. 5. Specifically, the potential in the second node $ND_2$ rises. The quantity of this potential rise is denoted by reference character ΔV. The potential difference $V_{gs}$ between the gate electrode of the drive transistor $TR_D$ and the other source/drain region serving as the source region is given by formula (5), which will be described later.

In time period $[TP(2)_8]$, the write transistor $TR_W$ is brought into the non-conductive state. In the display element 10, a voltage dependent on the video signal voltage $V_{Sig_m}$ is kept in the capacitor $C_1$ by a write operation. Since the scan signal from the scan line has ceased, the write transistor $TR_W$ is brought into the non-conductive state. Consequently, the application of the video signal voltage $V_{Sig_m}$ to the gate electrode of the drive transistor $TR_D$ ceases and thus a current dependent on the value of the voltage kept in the capacitor $C_1$ by the write operation flows through the drive transistor $TR_D$ into the light emitting unit ELP, thereby causing the light emitting unit ELP to emit light.

The operations of the display element 10 will now be described in more detail. The one source/drain region of the drive transistor $TR_D$ is kept in a state in which the drive voltage $V_{CC-H}$ from the power supply unit 100 is applied thereto, and the first node $ND_1$ is electrically disconnected from the data line $DTL_n$. Consequently, the potential in the second node $ND_2$ rises.

Here, due to the gate electrode of the drive transistor $TR_D$ being in a floating state and the presence of the capacitor $C_1$, a phenomenon similar to that in the so-called bootstrap circuit arises in the gate electrode of the drive transistor $TR_D$ and the potential in the first node $ND_1$ also rises, as described above. Consequently, the potential difference $V_{gs}$ between the gate electrode of the drive transistor $TR_D$ and the other source/drain region serving as the source region retains the value in formula (5). The current flowing into the light emitting unit ELP is the drain current $I_{ds}$ flowing from the drain region of the drive transistor $TR_D$ to the source region and is given by formula (6), which will be described later.

The light emitting state of the light emitting unit ELP continues until the (m+m'−1)-th horizontal scan period. The end of the (m+m'−1)-th horizontal scan period corresponds to the end of time period $[TP(2)_{-1}]$. Here, "m'" satisfies the relationship 1<m'<M and is controlled independently for each row of display elements in this embodiment of the present disclosure.

The light emitting unit ELP is driven and emits light during a time period from the beginning of time period $[TP(2)_8]$ until immediately before the (m+m')-th horizontal scan period $H_{m+m'}$. Usually, since the time taken for a threshold voltage cancelling process is sufficiently shorter than the light emitting period, the time period during which the drive voltage $V_{CC-H}$ is being supplied to the power supply line PS1 can virtually be treated as the light emitting period.

The basic operations of the display device 1 have been described above.

Referring now to FIGS. 6 to 13, operations of the display device 1 unique to this embodiment of the present disclosure will be described in detail.

Figure 6:
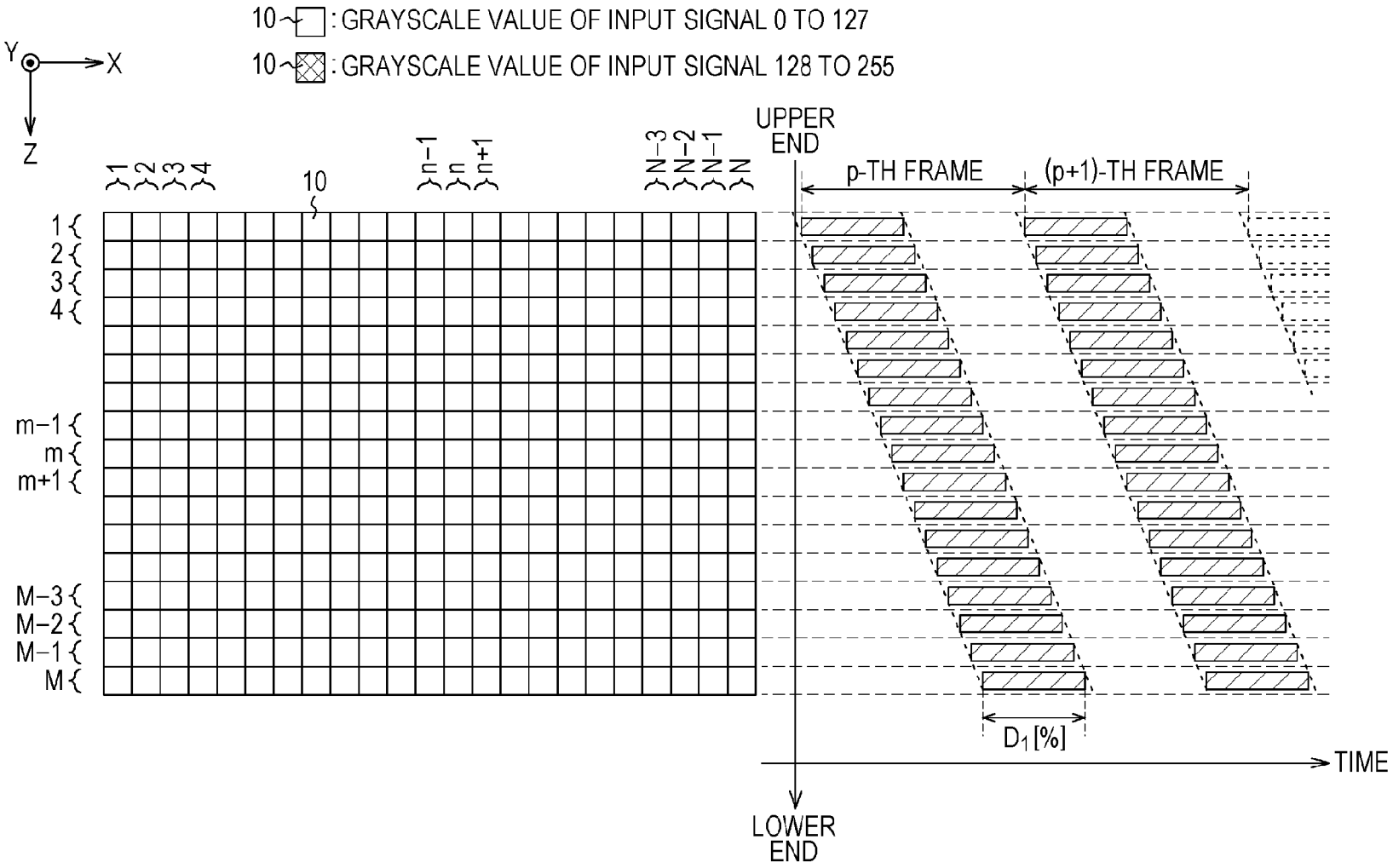
FIG. 6 is a schematic view illustrating the relationship between the grayscales of the input signals corresponding to the display elements and the duty ratios of the drive voltage in the power supply lines corresponding to the pixel rows.
Figure 7:
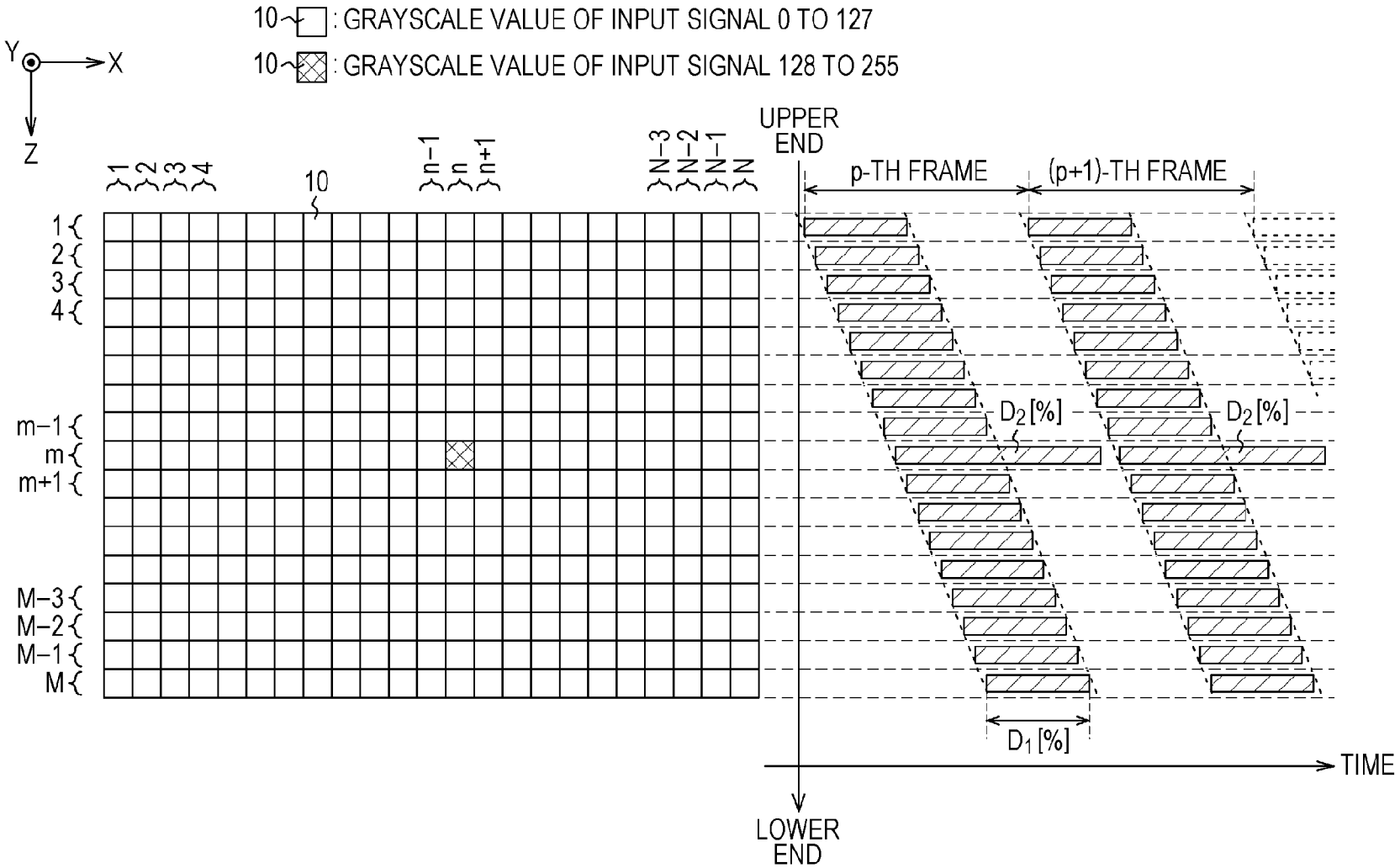
FIG. 7 is a schematic view continued from FIG. 6, illustrating the relationship between the grayscales of the input signals corresponding to the display elements and the duty ratios of the drive voltage in the power supply lines corresponding to the pixel rows.
Figure 8:
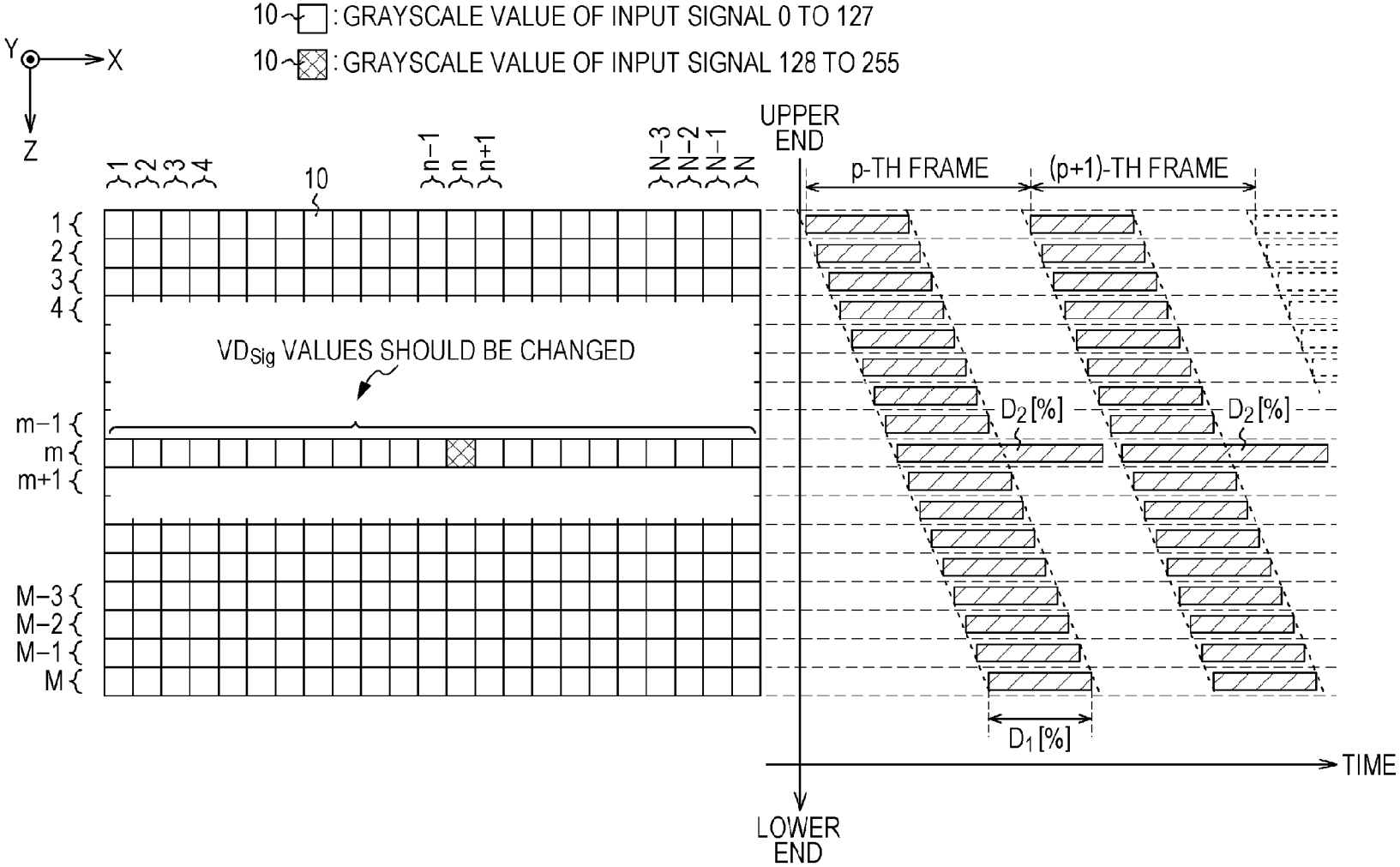
FIG. 8 is a schematic view illustrating the display elements for which the video signal values should be changed by changing the duty ratios of the drive voltage.
Figure 9:
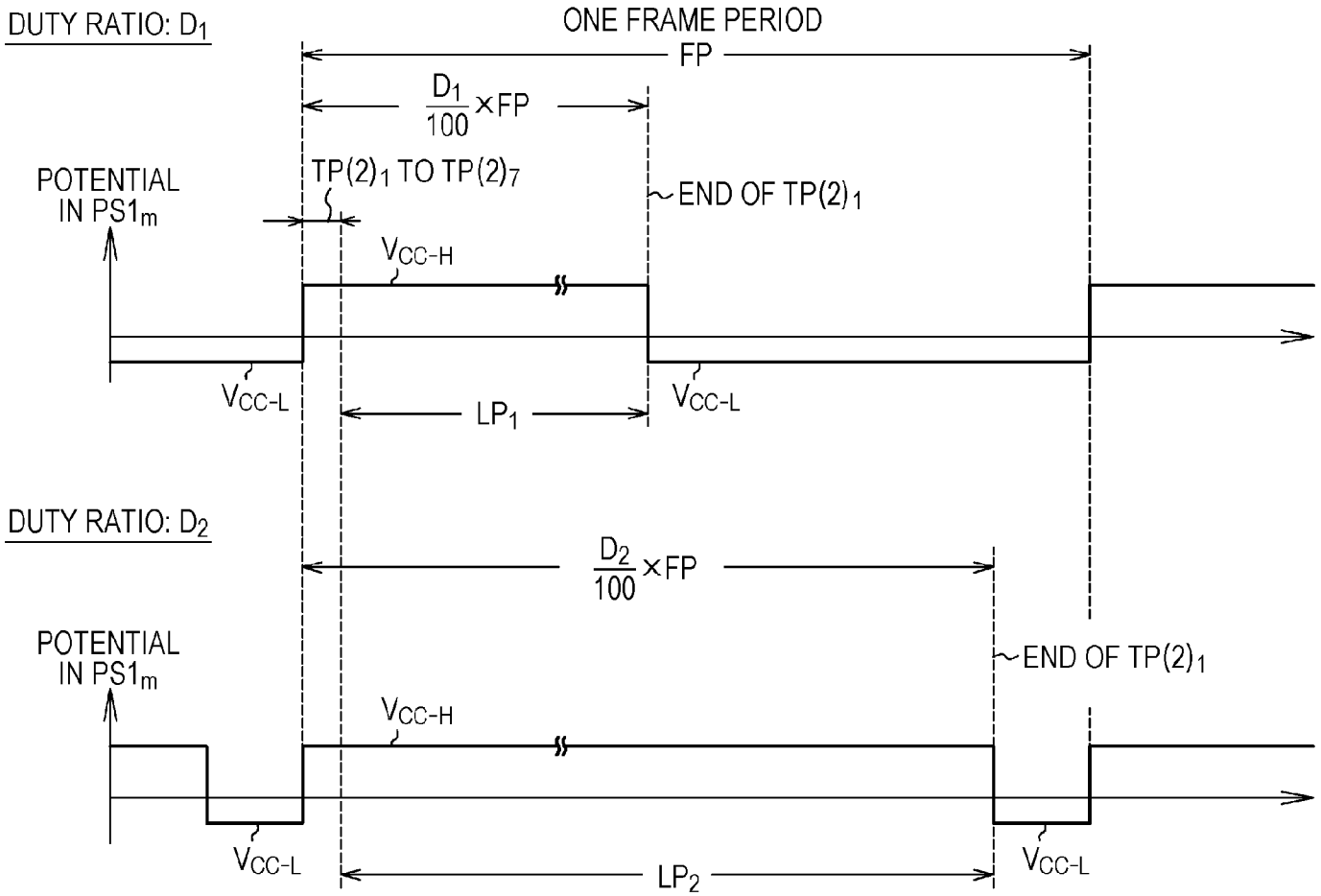
FIG. 9 is a schematic graph illustrating the duty ratios of a drive voltage applied to a power supply line.

FIG. 6 is a schematic view illustrating the relationship between the grayscales of the input signals corresponding to the display elements and the duty ratios of the drive voltage in the power supply lines corresponding to the pixel rows. FIG. 7 is a schematic view continued from FIG. 6, illustrating the relationship between the grayscales of the input signals corresponding to the display elements and the duty ratios of the drive voltage in the power supply lines corresponding to the pixel rows. FIG. 8 is a schematic view illustrating the display elements for which the values of the video signals $VD_{Sig}$ should be changed by changing the duty ratios of the drive voltage. FIG. 9 is a schematic graph illustrating the duty ratios of the drive voltage applied to a power supply line.

As described above with reference to FIG. 2, the duty ratios of the drive voltage in the power supply lines PS1 are controlled for each power supply line PS1 on the basis of the results of detection of the maximum grayscale values of the input signals $DT_{Sig}$ corresponding to the display elements 10 connected to the power supply lines PS1. The duty ratios of the drive voltage are set to the above-mentioned value $D_1$ (e.g. 45[%]) when the detection results are equal to or less than "127", or to the above-mentioned value $D_2$ (e.g. 90[%]) when the detection results are equal to or more than "128".

Accordingly, as shown in FIG. 6, when the grayscale values of the corresponding input signals $DT_{Sig}$ in all the display elements 10 of the display unit 20 are equal to or less than "127", for example, the duty ratios of the drive voltage in all the power supply lines $PS1_1$-$PS1_M$ are controlled so as to become value $D_1$. An example of waveform in the power supply line $PS1_m$ is shown in the upper half of FIG. 9.

Next, an operation in a case in which the grayscale values of the input signals $DT_{Sig}$ corresponding to some display elements 10 become equal to or more than "128" will be described.

When only the grayscale value of the input signal $DT_{Sig}$-corresponding to the (n,m)-th display element 10 becomes equal to or more than "128", for example, the duty ratio of the drive voltage in the power supply line $PS1_m$ becomes value $D_2$ as shown in FIG. 7. An example of waveform in the power supply line $PS1_m$ is shown in the lower half of FIG. 9.

Consequently, the light emitting period and luminance of the display elements 10 in the m-th row become substantially twice those in the display elements 10 in the other rows. It is necessary, therefore, to change the values of the video signals $VD_{Sig}$ in the display elements 10 in the m-th row to a suitable value as shown in FIG. 8 in order to keep linearity between the grayscale values of the input signals $DT_{Sig}$- and the luminance of the image.

In the display device 1, when the duty ratio of the drive voltage is value $D_1$ and the grayscale value of the input signal $DT_{Sig}$ is 0-127, the value of the video signal $VD_{Sig}$ is controlled so as to match the grayscale value of the input signals $DT_{Sig}$.

Here, when the duty ratio is set to value $D_2$, a problem will occur if the grayscale values of the input signals $DT_{Sig}$ are simply multiplied by $D_1/D_2$ to determine values of the video signals $VD_{Sig}$ such that the luminance changes linearly with respect to the grayscale values of the input signals $DT_{Sig}$. This will be described with reference to FIGS. 10A to 12.

Figure 10A:
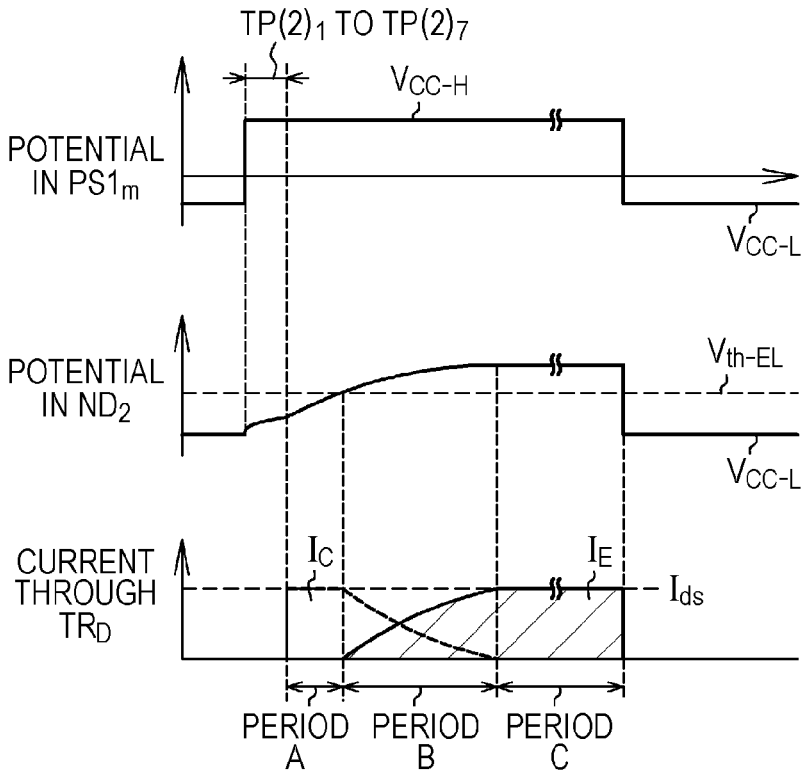
FIG. 10A is a schematic view illustrating the relationship between the potential in the power supply line, the potential in the second node, and the drain current flowing through the drive transistor.
Figure 10B:
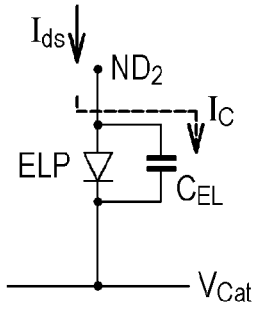
FIGS. 10B, 10C, and 10D are schematic views illustrating how the drain current flows during the periods A, B, and C shown in FIG. 10A.
Figure 10C:
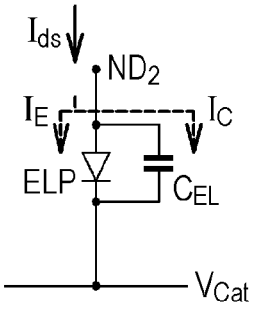
Figure 10D:
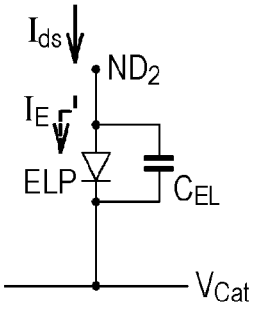

FIG. 10A is a schematic view illustrating the relationship between the potential in the power supply line, the potential in the second node, and the drain current flowing through the drive transistor. FIGS. 10B, 10C, and 10D are schematic views illustrating the flows of the drain current in the periods A, B, and C in FIG. 10A.

Referring now to FIGS. 10A to 10D, the relationship between the potential in the power supply line PS1, potential in the second node $ND_2$, and the drain current $I_{ds}$ flowing through the drive transistor $TR_D$ will be described.

As shown in FIG. 10A, when the potential in the power supply line $PS1_m$ changes from the initialization voltage $V_{CC-L}$ to the drive voltage $V_{CC-H}$, a drain current $I_{ds}$ flows through the drive transistor $TR_D$ after the time period $[TP(2)_7]$ described with reference to FIG. 5. Accordingly, the potential in the second node $ND_2$ rises after a write operation.

Here, in [period A] in which the potential in the second node $ND_2$ does not exceed the threshold voltage $V_{th-EL}$ of the light emitting unit ELP, the drain current $I_{ds}$ flows only into the capacitor $C_{EL}$ in the light emitting unit ELP (see FIG. 10B). Reference character $I_C$ denotes the portion of the drain current $I_{ds}$ that flows into the capacitor $C_{EL}$, while reference character $I_E$ denotes the portion of the drain current $I_{ds}$ that flows into the light emitting unit ELP. In [period B] before the potential in the second node $ND_2$ reaches a certain value after exceeding the threshold voltage $V_{th-EL}$ of the light emitting unit ELP, the drain current $I_{ds}$ flows into both the capacitor $C_{EL}$ and the light emitting unit ELP (see FIG. 10C). This means that [period A] is the "time elapsed before the light emitting unit starts emitting light". In [period C] after the potential in the second node $ND_2$ reaches the certain value, the drain current $I_{ds}$ flows only into the light emitting unit ELP (see FIG. 10D). The current $I_C$ flowing into the capacitor $C_{EL}$ does not contribute to the emission of light. The portion (quantity of electric charge) of the drain current $I_{ds}$ that contributes to the emission of light is the area indicated by hatching in FIG. 10A.

Figure 11A:
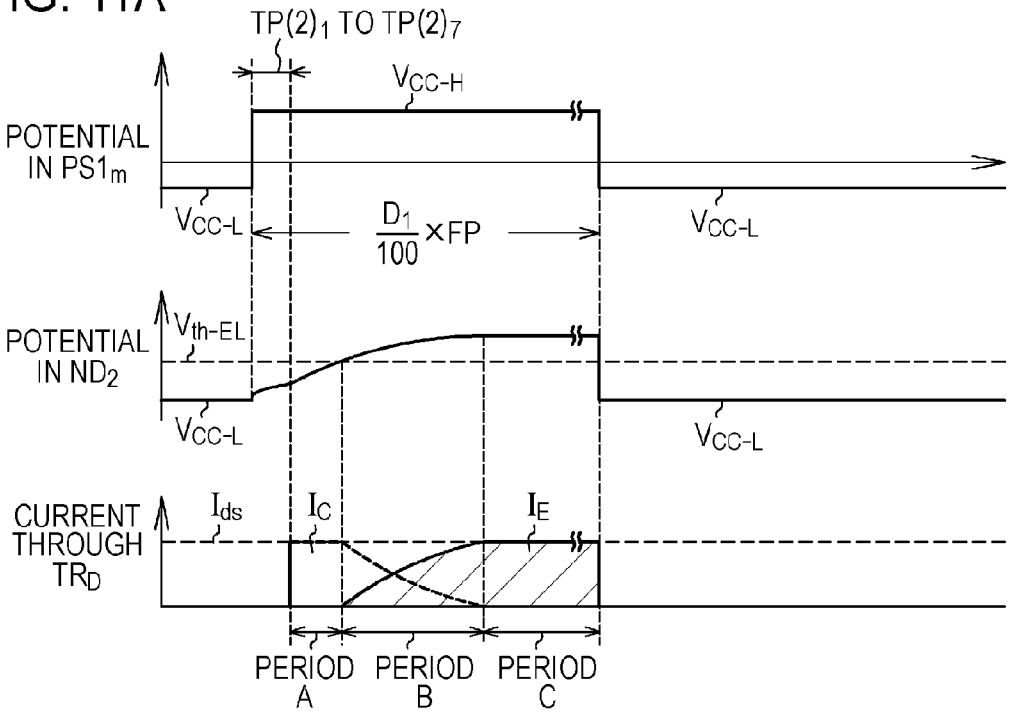
FIG. 11A is a schematic view illustrating the relationship between the potential in the power supply line, the potential in the second node, and the drain current flowing through the drive transistor when the duty ratio of the drive voltage applied to the power supply line is $D_1$[%]
Figure 11B:
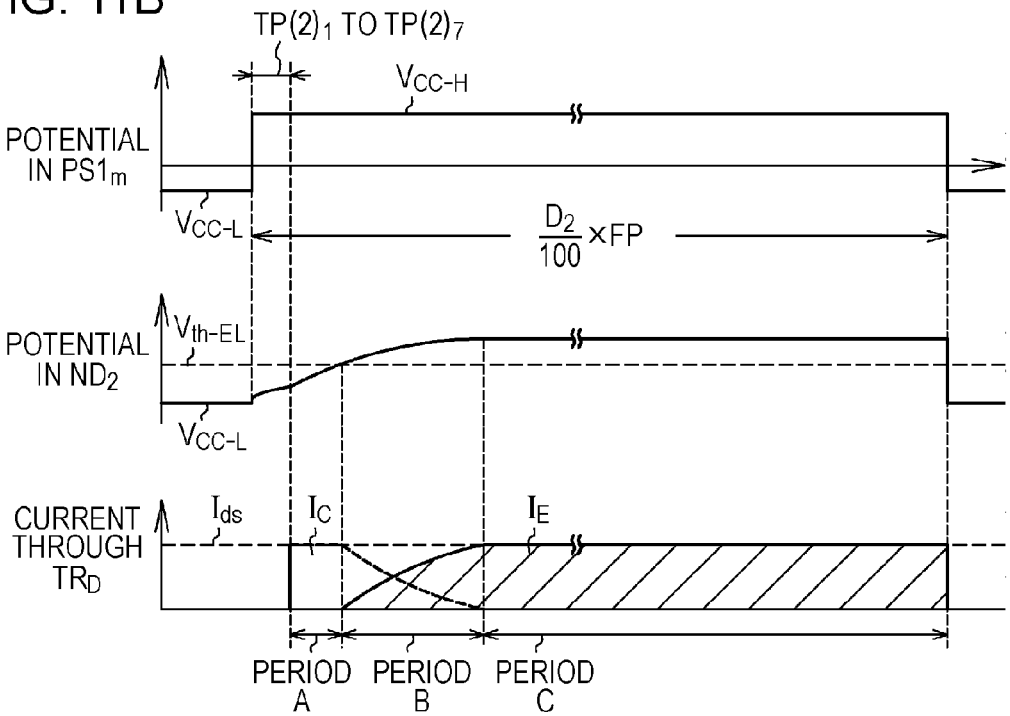
FIG. 11B is a schematic view illustrating the relationship between the potential in the power supply line, the potential in the second node, and the drain current flowing through the drive transistor when the duty ratio of the drive voltage applied to the power supply line is $D_2$[%]

FIG. 11A is a schematic view illustrating the relationship between the potential in the power supply line, the potential in the second node, and the drain current flowing through the drive transistor when the duty ratio of the drive voltage applied to the power supply line is $D_1$[%]. FIG. 11B is a schematic view illustrating the relationship between the potential in the power supply line, the potential in the second node, and the drain current flowing through the drive transistor when the duty ratio of the drive voltage applied to the power supply line is $D_2$[%].

In this case, the duty ratio of the drive voltage in FIG. 11B is twice that in FIG. 11A. Due to the presence of [period A] and [period B], however, the doubled duty ratio of the drive voltage does not mean that the luminance in the operating state in FIG. 11B becomes twice the luminance in the operating state in FIG. 11A.

If values of the video signals $VD_{Sig}$ in the state in which the duty ratio is set to value $D_2$ are determined simply by multiplying the grayscale values of the input signals $DT_{Sig}$ by $D_1/D_2$, the linearity between the grayscale values of the input signals $DT_{Sig}$ and the luminance of the displayed image may be lost.

The lengths of [period A] and [period B] also vary with the value of the drain current flowing through the drive transistor.

Figure 12:
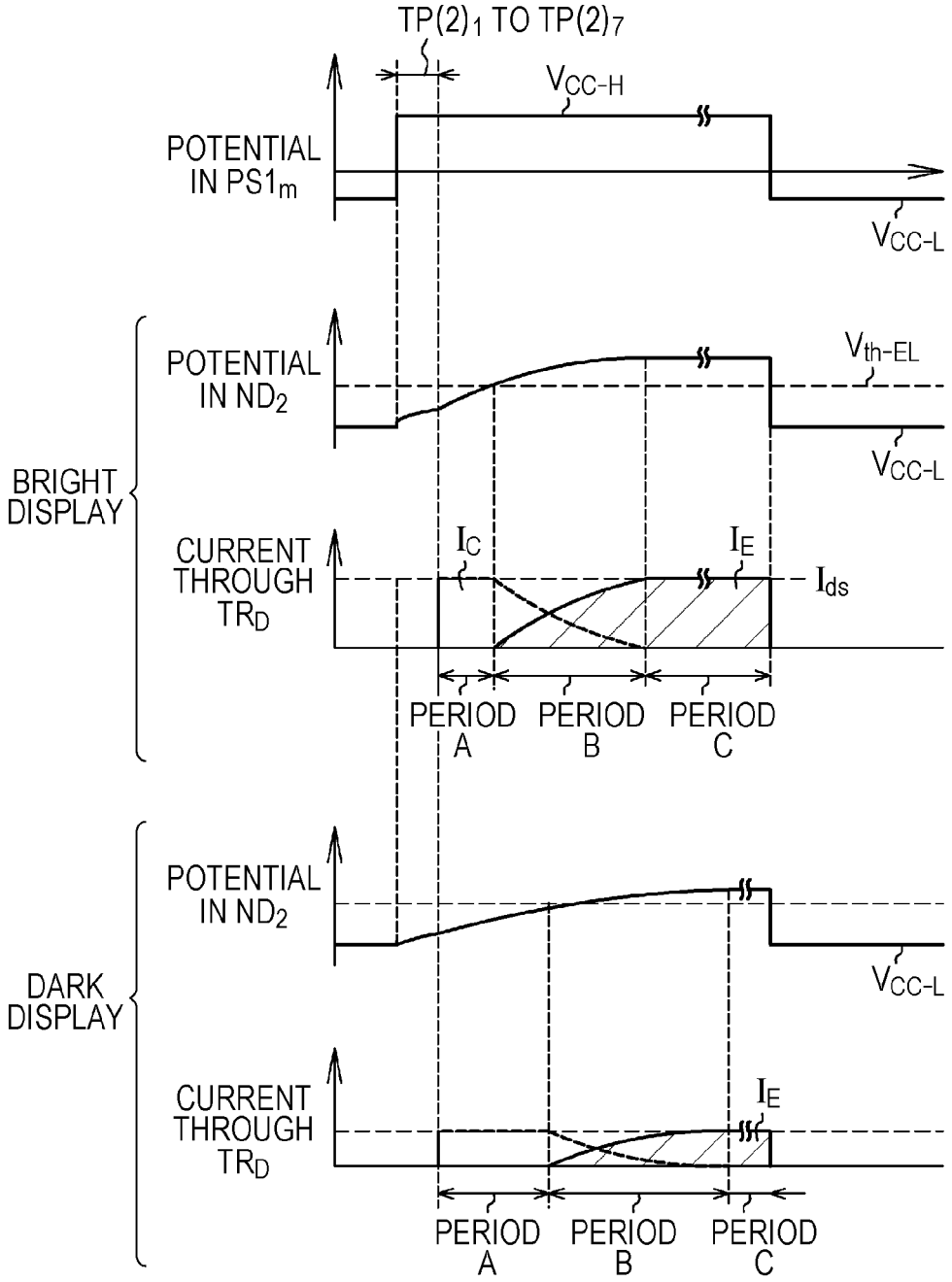
FIG. 12 is a schematic view illustrating the relationship between the potential in the second node and the drain current flowing through the drive transistor to display a bright image when the duty ratio of the drive voltage to be applied to the power supply line is constant, as well as the relationship between the potential in the second node and the drain current flowing through the drive transistor to display a dark image when the duty ratio of the drive voltage to be applied to the power supply line is constant.

FIG. 12 is a schematic view illustrating the relationship between the potential in the second node and the drain current flowing through the drive transistor to display a bright image, as well as the relationship between the potential in the second node and the drain current flowing through the drive transistor to display a dark image, when the duty ratios of the drive voltage applied to the power supply lines are constant.

The length of [period A] described above is given by the length of time elapsed before the potential difference across the capacitor $C_{EL}$ exceeds the threshold voltage $V_{th\text{-}EL}$ of the light emitting unit ELP due to the drain current flowing into the capacitor $C_{EL}$ in the light emitting unit ELP.

At the beginning of [period A], the potential in the second node is $(V_{Ofs}-V_{th})$, which will be described later in detail with reference to FIG. 5 and so on. If the voltage $V_{Cat}$ applied to the cathode of the light emitting unit ELP is 0 [volts], the length of [period A], i.e., "time elapsed before the light emitting unit starts emitting light" is given by the formula $T_A=\{V_{th\text{-}EL}-(V_{Ofs}-V_{th})\}\cdot C_{EL}/I_{ds}$, where reference character $T_A$ is the length of [period A]. As is clear from this formula, the length $T_A$ of the "time elapsed before the light emitting unit starts emitting light" varies with the current flowing into the light emitting unit ELP.

The length $T_A$ may sometimes extend over several milliseconds. It will become innegligible with respect to one frame period if a high refresh rate is set in the display device.

In the display device 1, the value of the video signal $VD_{Sig}$ corresponding to the value of the duty ratio of the drive voltage and the value of the input signal $DT_{Sig}$ is set so as to compensate for an influence of the length of time elapsed before the light emitting unit starts emitting light that varies with the value of the current flowing into the light emitting unit.

Specifically, in the video signal value table storage unit shown in FIG. 2, there are stored values of the video signals $VD_{Sig}$ corresponding to the values of the duty ratios of the drive voltage and the values of the input signals $DT_{Sig}$ and determined so as to compensate for an influence of the length of time elapsed before the light emitting unit starts emitting light that varies with the value of the current flowing into the light emitting unit.

FIG. 13 is a schematic table illustrating the data stored in the video signal value table storage unit.

In FIG. 13, [Data($D_2$,127)], for example, indicates a value of the video signal $VD_{Sig}$ that is determined such that the luminance of the screen corresponds to the grayscale value "127" when the duty ratio of the drive voltage is value $D_2$, while [Data($D_2$,255)] indicates a value of the video signal $VD_{Sig}$ that is determined such that the luminance of the screen corresponds to the grayscale value "255" when the duty ratio of the drive voltage is value $D_2$. The same applies to the others.

These values can be obtained using the duty ratio values $D_1$, $D_2$ and the length $T_A$ of "time elapsed before the light emitting unit starts emitting light".

When the duty ratio is value $D_2$, an image can be reproduced with substantially the same luminance as the luminance of the image to be displayed when the duty ratio is value $D_1$, a drain current $I_{ds_D1}$ is flowing into the light emitting unit ELP, and the length of "time elapsed before the light emitting unit starts emitting light" is $T_{A_D1}$, if the condition $I_{ds_D2}=I_{ds_D1}\times\{(D_1/100)-(T_{A_D1}/FR)\}/\{(D_2/100)-(T_{A_D2}/FR)\}$ is satisfied, where $I_{ds_D2}$ is the drain current and $T_{A_D2}$ is the length of "time elapsed before the light emitting unit starts emitting light" when the duty ratio is value $D_2$. Accordingly, a value of the video signal $VD_{Sig}$ for applying this drain current $I_{ds_D2}$ should be selected.

Alternatively, a suitable value of the video signal $VD_{Sig}$ may be selected by actual measurement. The value selected by actual measurement will compensate for an influence of [period B] in FIG. 10C.

In the display device 1, the duty ratios of the drive voltage are set to relatively small values, except for rows including the display elements that should display with a certain luminance. By setting the duty ratios in the rows including the display elements that should display with a certain luminance to relatively high values, an image can be displayed with necessary luminance without having to set the drive voltage to a high value. This means that blurs of moving images can be reduced and images can be displayed with high luminance without having to set the drive voltage to a high value.

Next, a variant of this embodiment will be described.

Figure 14:
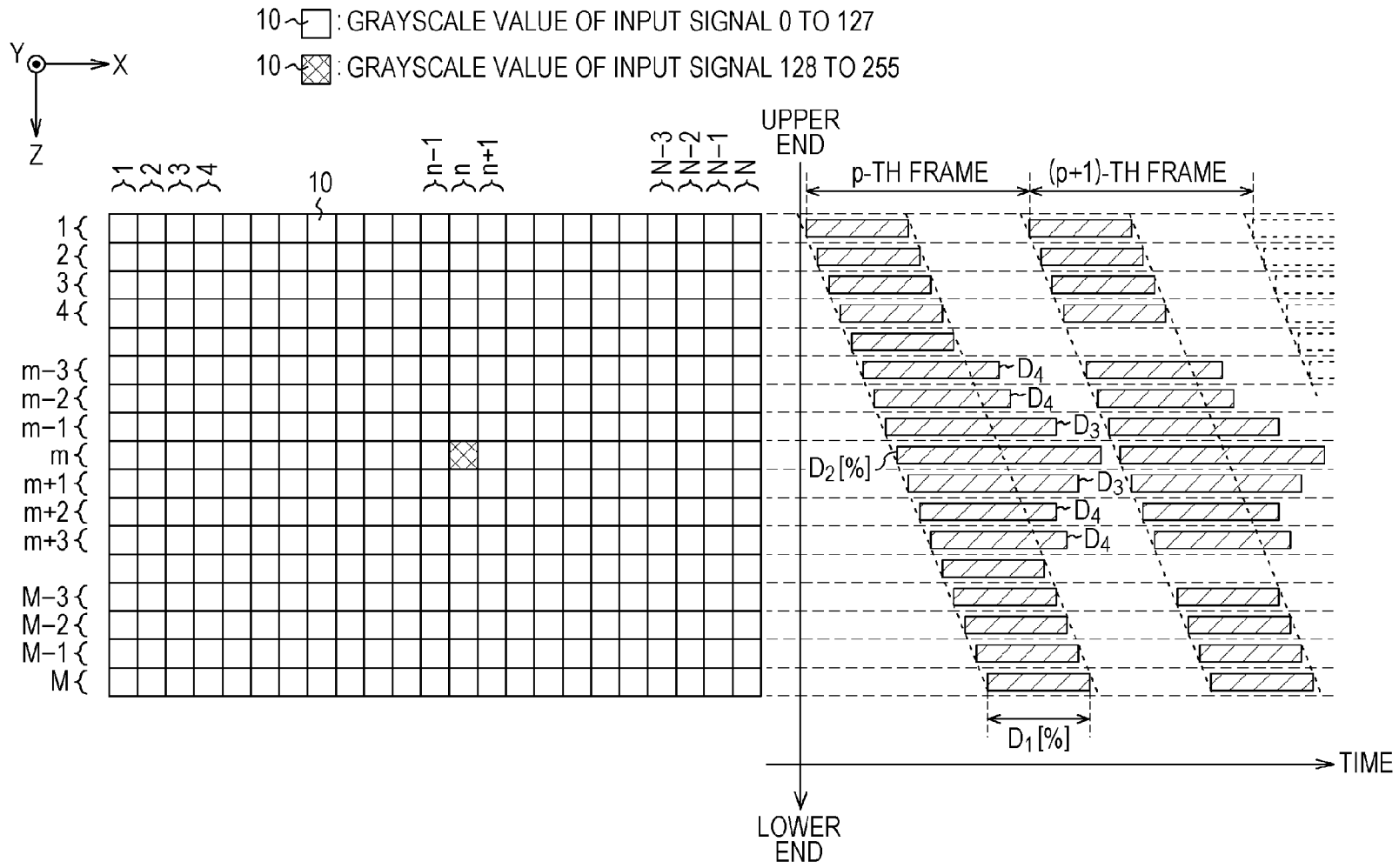
FIG. 14 is a schematic view illustrating the relationship between the grayscales of the input signals corresponding to the display elements and the duty ratios of the drive voltage in the power supply lines corresponding to the pixel rows in a variant of the embodiment.

FIG. 14 is a schematic view illustrating the relationship between the grayscales of the input signals corresponding to the display elements and the duty ratios of the drive voltage in the power supply lines corresponding to the pixel rows.

In the example shown in FIG. 8, the duty ratio of the drive voltage is set to value $D_2$ only in the power supply line $PS1_m$ connected to the display elements 10 in the m-th row. In this case, the difference in duty ratio from the adjacent rows may become significant and produce a noticeable incongruity in the image quality.

In this variant, when the vicinity of the row having the maximum grayscale value exceeding the predetermined reference value is occupied by rows having the maximum grayscale values not exceeding the predetermined reference value, the control unit controls the duty ratios of the drive voltage in the rows adjacent to the row having the maximum grayscale value exceeding the predetermined reference value such that the duty ratios in the adjacent rows closer to the row having the maximum grayscale value exceeding the predetermined reference value become closer to the predetermined value $D_2$ and control the values of the video signals $VD_{Sig}$ corresponding to the display elements 10.

In the example shown in FIG. 14, the duty ratio of the drive voltage in the m-th row is set to value $D_2$, the duty ratios in the (m−1)-th and (m+1)-th rows are set to value $D_3$ (e.g. 75[%]), the duty ratios in the (m−2)-th and (m−3)-th rows and the (m+2)-th and (m+3)-th rows are set to value $D_4$ (e.g. 60[%]), and the duty ratios in the other rows are set to value $D_1$ (e.g. 45[%]).

Figure 15:
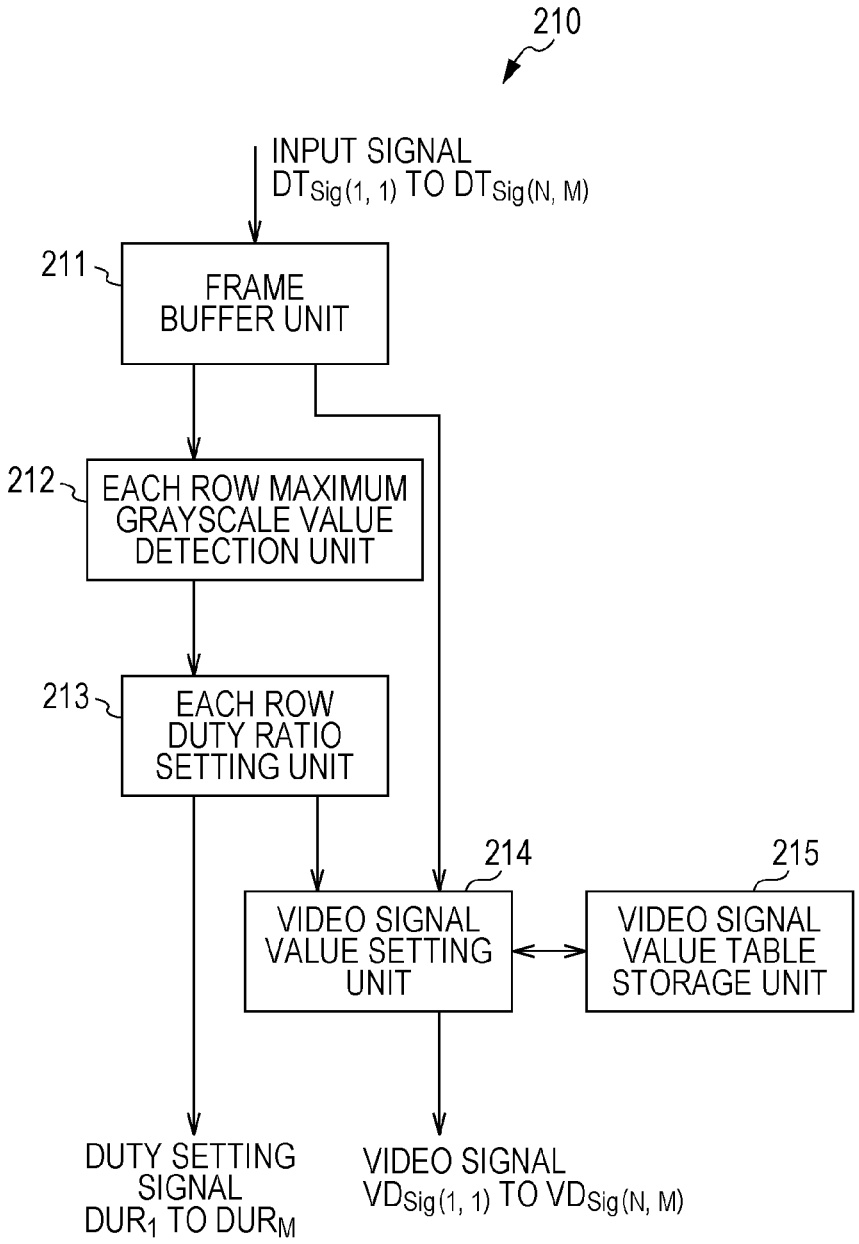
FIG. 15 is a schematic block diagram illustrating the configuration and operation of the control unit used in the display device in the variant.
Figure 17A:
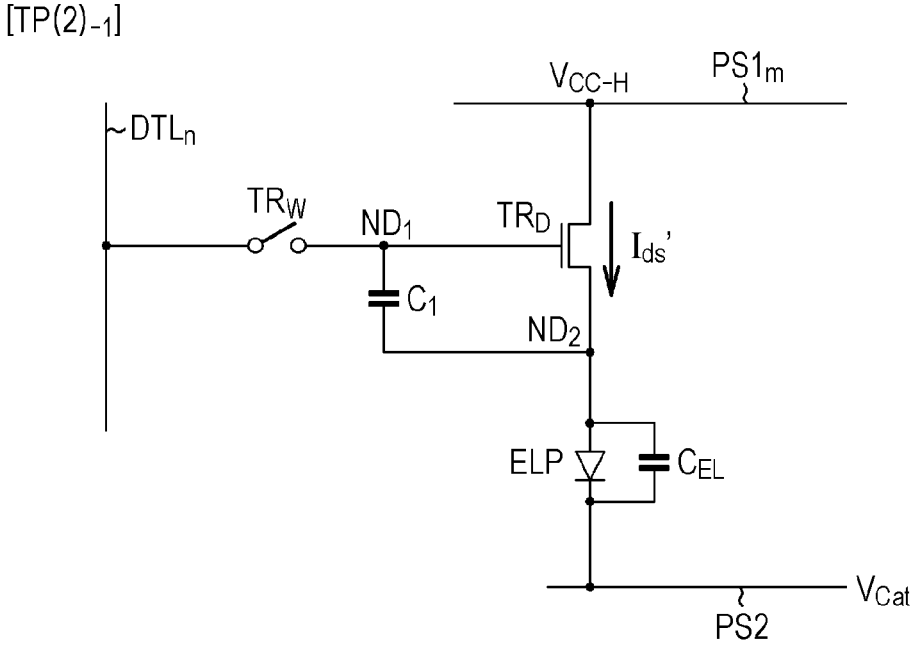
FIGS. 17A and 17B schematically show the conductive and non-conductive states of the transistors forming part of the drive circuit of the display element.
Figure 17B:
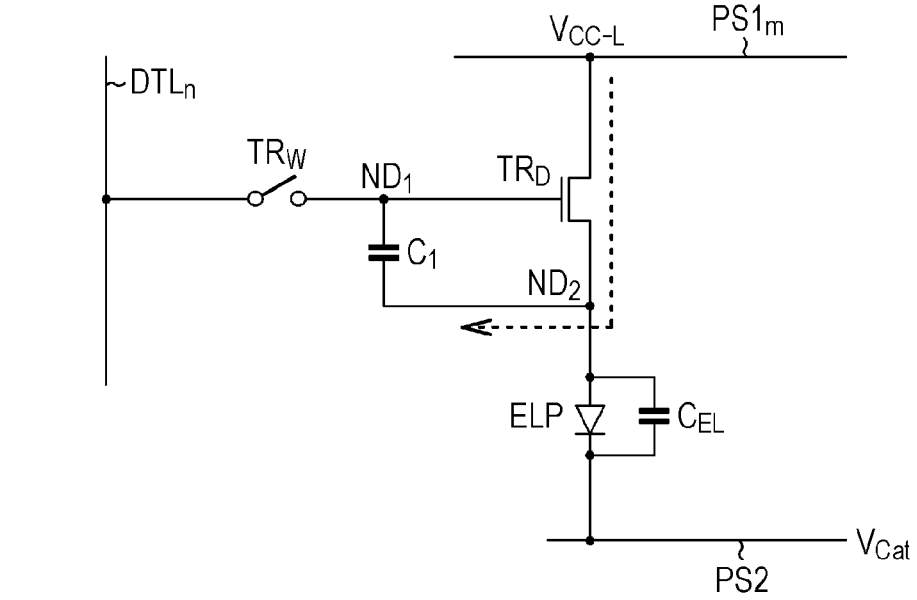
Figure 18A:
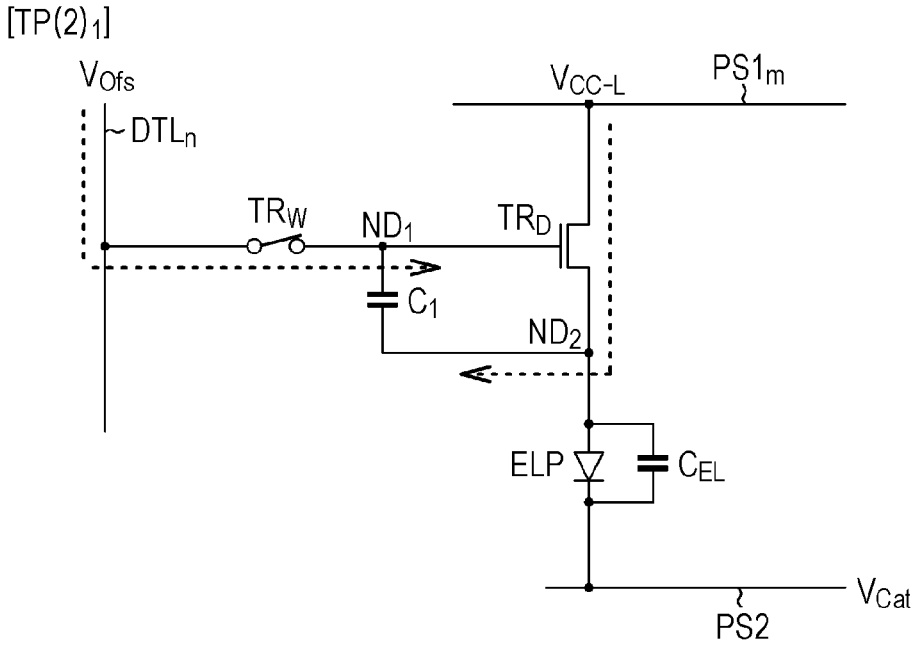
FIGS. 18A and 18B are continuations from FIG. 17B, schematically showing the conductive and non-conductive states of the transistors forming part of the drive circuit of the display element.
Figure 18B:
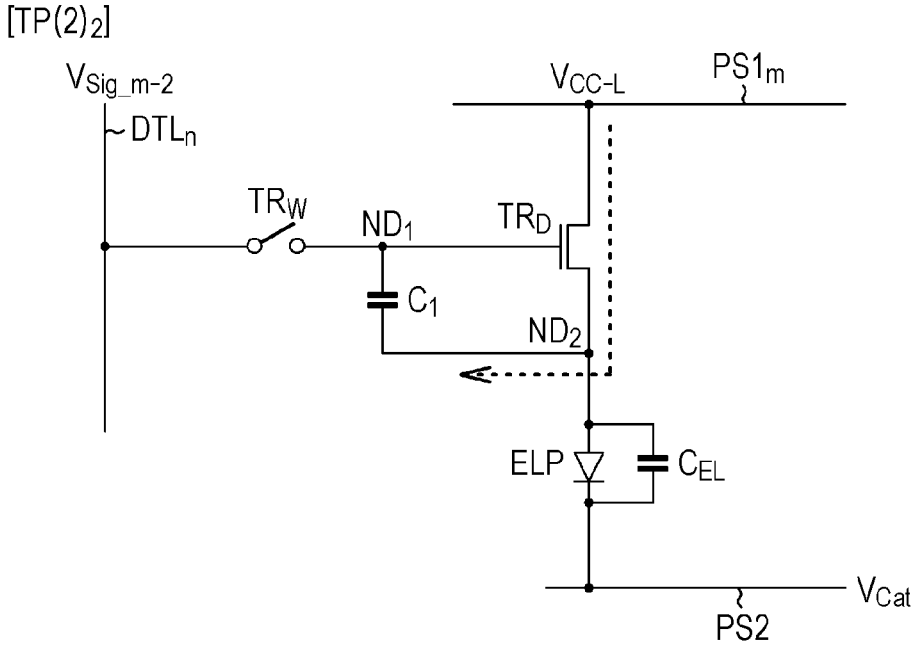
Figure 19A:
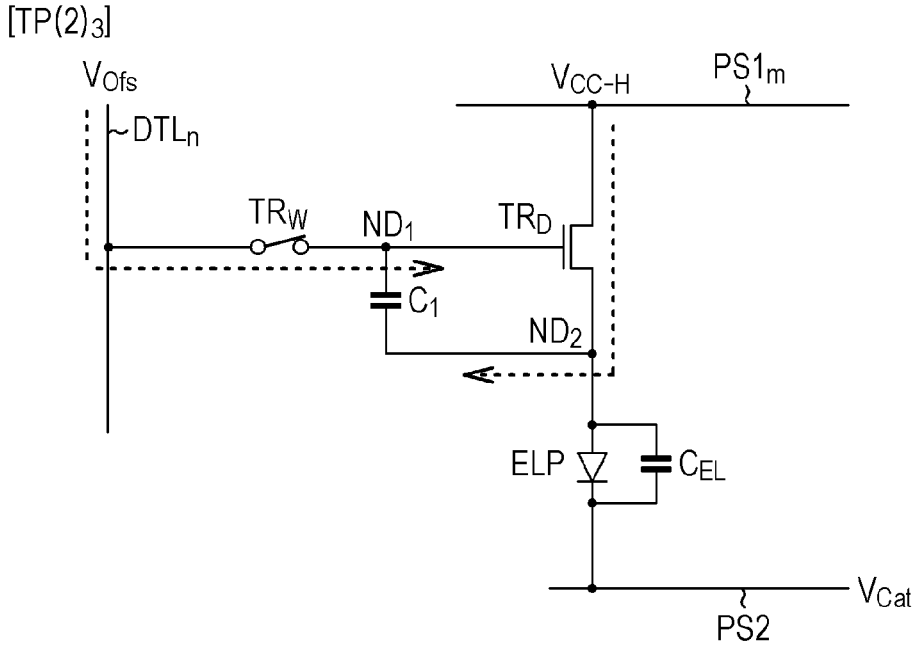
FIGS. 19A and 19B are continuations from FIG. 18B, schematically showing the conductive and non-conductive states of the transistors forming part of the drive circuit of the display element.
Figure 19B:
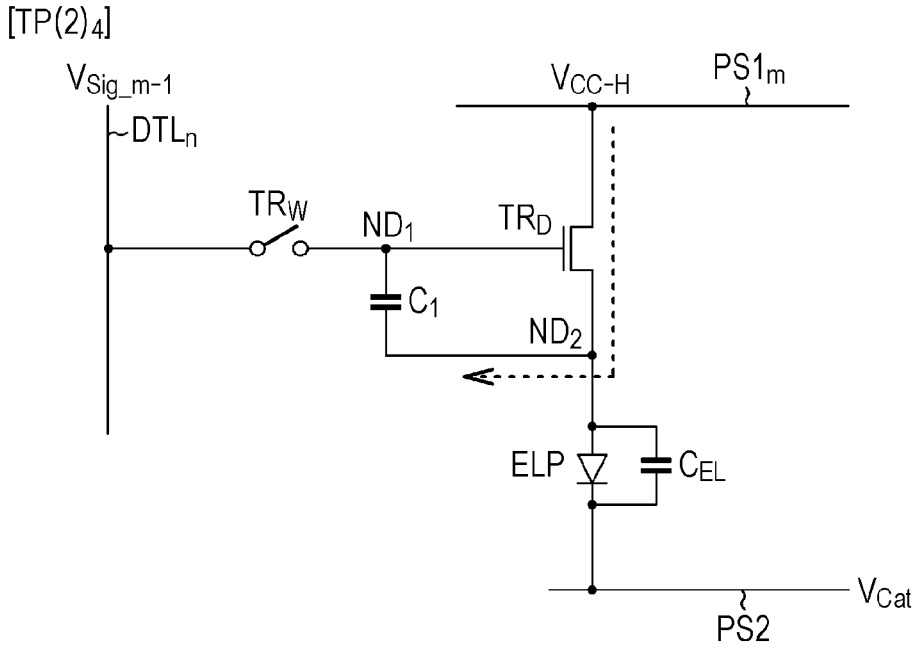
Figure 20A:
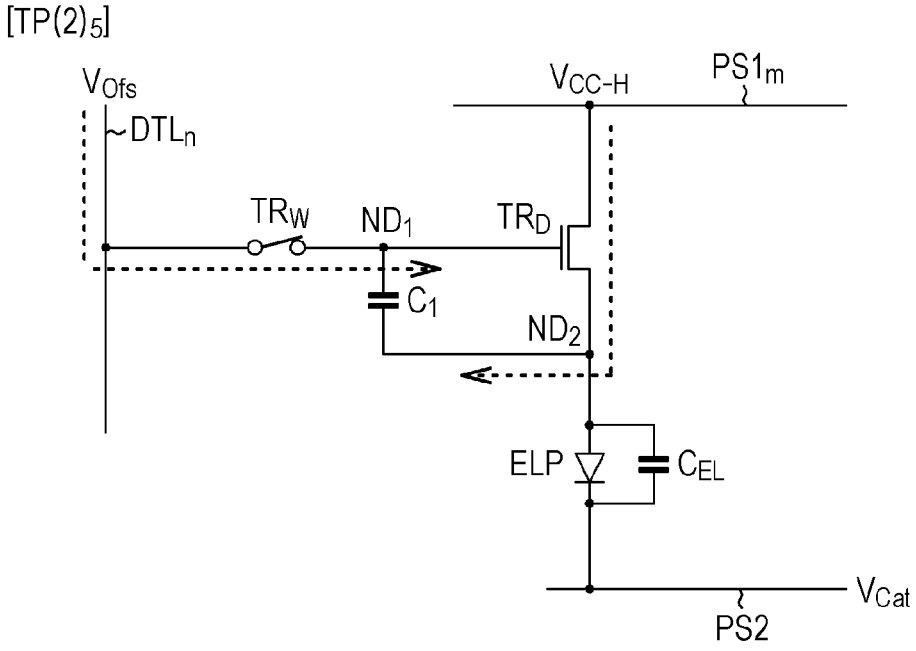
FIGS. 20A and 20B are continuations from FIG. 19B, schematically showing the conductive and non-conductive states of the transistors forming part of the drive circuit of the display element.
Figure 20B:
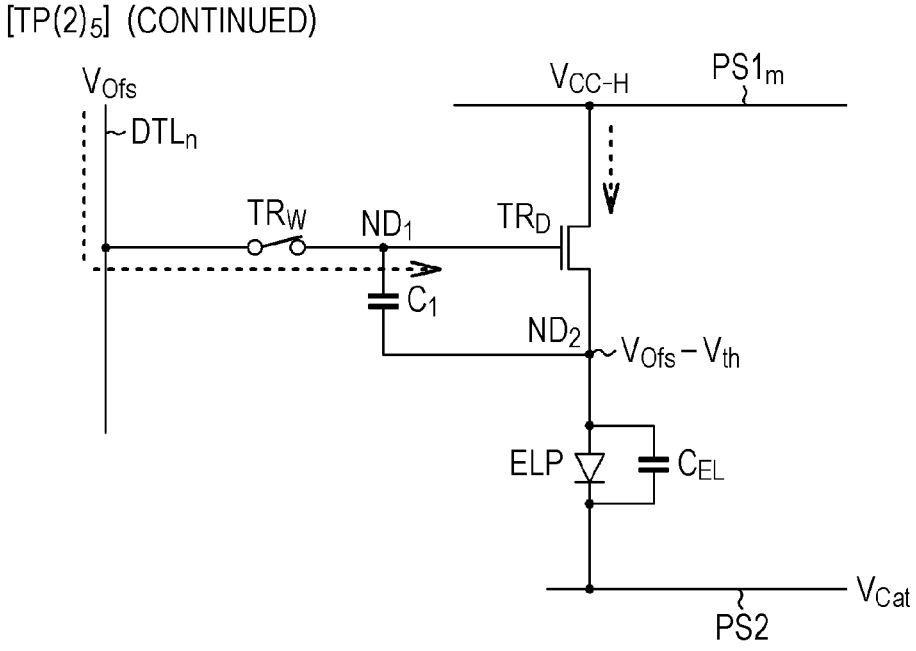
Figure 21A:
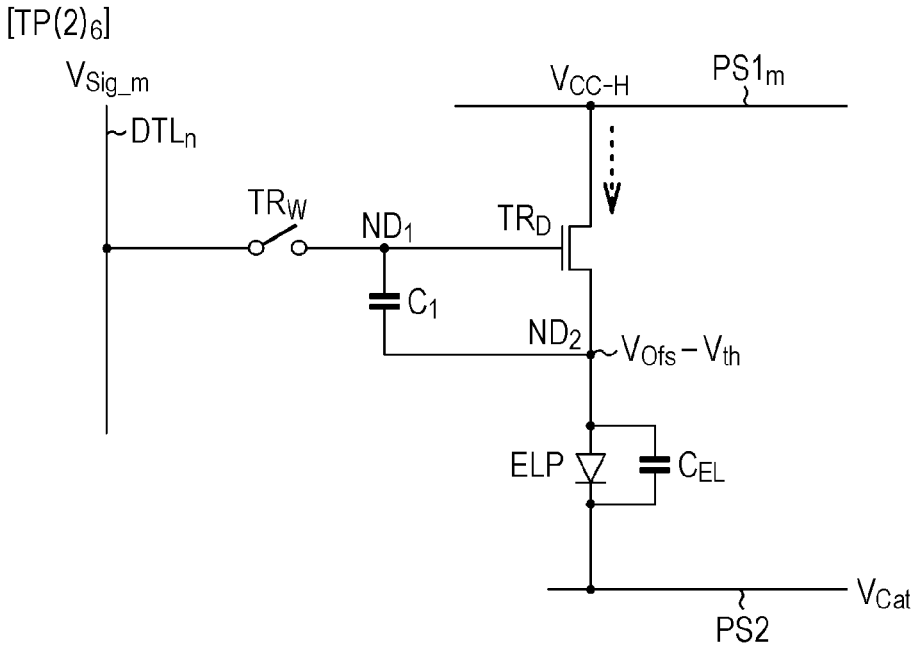
FIGS. 21A and 21B are continuations from FIG. 20B, schematically showing the conductive and non-conductive states of the transistors forming part of the drive circuit of the display element.
Figure 21B:
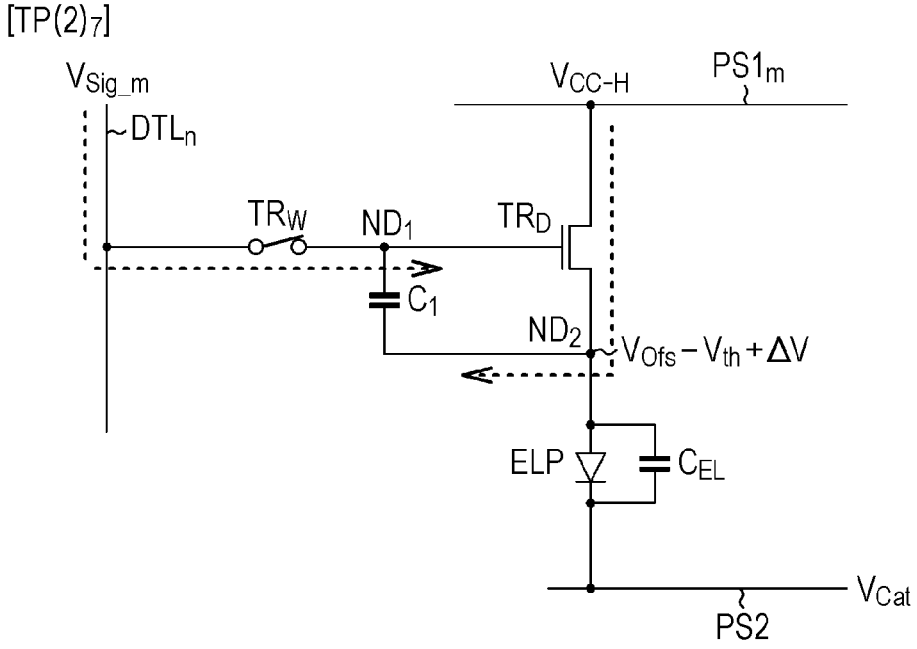
Figure 22:
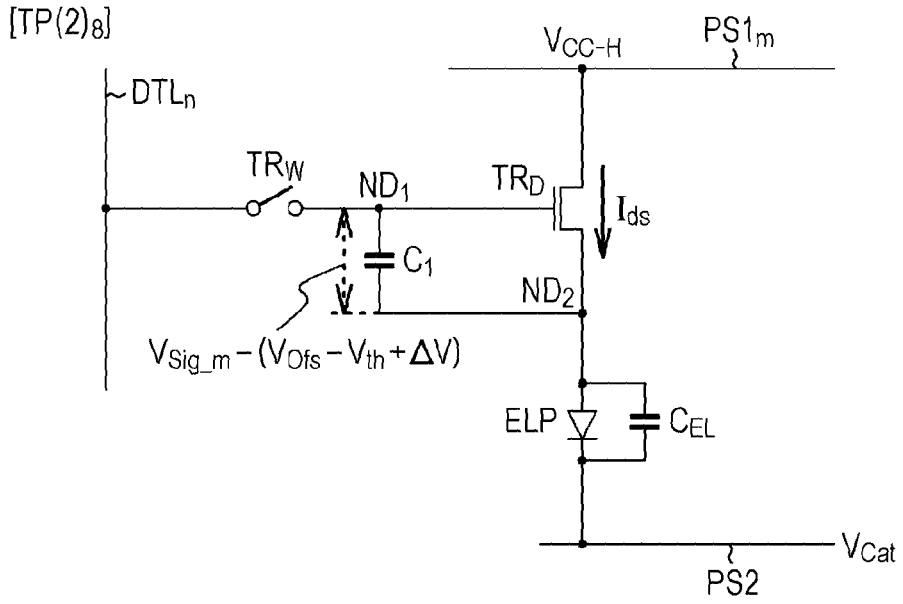
FIG. 22 is a continuation from FIG. 21B, schematically showing the conductive and non-conductive states of the transistors forming part of the drive circuit of the display element.

FIG. 15 is a schematic block diagram illustrating the configuration and operation of the control unit used in the display device in the variant.

In the conceptual diagram of the display device in this variant, the control unit 110 in FIG. 1 may read the control unit 210.

Similarly to the control unit 110 described above, the control unit 210 receives input signals $DT_{Sig}$ dependent on the images to be displayed from a device (not shown), for example. On the basis of the input signals $DT_{Sig}$, the control unit 210 outputs video signals $VD_{Sig}$ and duty setting signals DUR for controlling the operation of the power supply unit 100.

The control unit 210 includes a frame buffer unit 211, each row maximum grayscale value detection unit 212, each row duty ratio setting unit 213, video signal value setting unit 214, and a video signal value table storage unit 215.

Input signals $DT_{Sig(1,1)}$ to $DT_{Sig(N,m)}$ input to the control unit 210 are held in the frame buffer unit 211. The each row maximum grayscale value detection unit 212 detects the maximum grayscale value in each row on the basis of the values held in the frame buffer unit 211.

The each row duty ratio setting unit 213 sets duty ratios of the drive voltage in the first to M-th rows on the basis of the results of detection by the each row maximum grayscale value detection unit 212.

Similarly to the control unit 110, the control unit 210 basically sets the duty ratio of the drive voltage to a predetermined value $D_1$ when the maximum grayscale value is equal to or less than the predetermined reference value, or to a predetermined value $D_2$ greater than the value $D_1$ when the maximum grayscale value exceeds the predetermined reference value. When the vicinity of the row having the maximum grayscale value exceeding the predetermined reference value is occupied by rows having the maximum grayscale values not exceeding the predetermined reference value, the control unit 210 sets the duty ratios of the drive voltage in the rows adjacent to the row having the maximum grayscale value exceeding the predetermined reference value such that the duty ratios in the adjacent rows closer to the row having the maximum grayscale value exceeding the predetermined reference value become closer to the predetermined value $D_2$. The each row duty ratio setting unit 213 supplies to the power supply unit 100 duty setting signals $DUR_1$-$DUR_M$ for controlling the duty ratios of the drive voltage in the power supply lines $PS1_1$-$PS1_M$.

The video signal value setting unit 214 controls the values of the video signals $VD_{Sig}$ corresponding to the display elements 10 in each row by setting the values of the video signals $VD_{Sig}$ on the basis of the duty ratios of the drive voltage set by the each row duty ratio setting unit 213 and the values of the input signals $DT_{Sig}$ held in the frame buffer unit 211.

In the video signal value table storage unit 215, there are held, in the form of a table, values of the video signals $VD_{Sig}$ corresponding to the values of the duty ratios of the drive voltage and the values of the input signals $DT_{Sig}$. The video signal value setting unit 214 sets video signals $VD_{Sig(1,1)}$ to $VD_{Sig(N,m)}$ by sequentially referencing the video signal value table storage unit 215 on the basis of the information from the each row duty ratio setting unit 213 and the information from the frame buffer unit and supplies these video signals to the signal output unit 102.

FIG. 16 is a schematic table illustrating the data stored in the video signal value table storage unit.

As described with reference to FIG. 13, [Data($D_3$,0)], for example, indicates the value of the video signal $VD_{Sig}$ that is determined such that the luminance of the screen corresponds to the grayscale value "0" when the duty ratio of the drive voltage is value $D_3$, while [Data($D_3$,127)] indicates the value of the video signal $VD_{Sig}$ determined such that the luminance of the screen corresponds to the grayscale value "127" when the duty ratio of the drive voltage is value $D_3$. The same applies to the others.

The variant of the embodiment has been described above.

Next, operations of the display device as a whole common to the embodiment and its variant will be described in detail with reference to FIGS. 5, 17A, 17B, 18A, 18B, 19A, 19B, 20A, 20B, 21A, 21B, and 22.

Time period [$TP(2)_{-1}$] (see FIGS. 5 and 17A):

Time period [$TP(2)_{-1}$] indicates the operation in the previous display frame, for example, in which the (n,m)-th display element 10 is in the light emitting state after various processes in the previous cycle have been completed. More specifically, a drain current $I_{ds}'$ based on the formula (5'), which will be described later, is flowing into the light emitting unit ELP of the display element 10 forming the (n,m)-th pixel and the luminance of the display element 10 forming the (n,m)-th pixel is a value corresponding to the drain current $I_{ds}'$. Here, the write transistor $TR_W$ is not conductive, while the drive transistor $TR_D$ is conductive. The light emitting state of the (n,m)-th display element 10 continues until immediately before the beginning of the horizontal scan period of the display elements 10 in the (m+m') row.

As described above, the reference voltage $V_{Ofs}$ and the video signal voltage $V_{Sig}$ are supplied to the data lines $DTL_n$ in correspondence with each horizontal scan period. Since the write transistor $TR_W$ is not conductive, however, the change in potential (voltage) in the data line $DTL_n$ in time period [$TP(2)_{-1}$] does not change the potentials in the first and second nodes $ND_1$, $ND_2$ (the potentials may actually change due to the capacitive coupling of parasitic capacitance etc. but these changes are negligible). The same applies to time period [$TP(2)_0$] which will be described later.

Time periods [$TP(2)_0$] to [$TP(2)_6$] shown in FIG. 5 are operating time periods after the end of the light emitting state following the completion of various processes in the previous cycle until immediately before the beginning of the next write operation. During time periods [$TP(2)_0$] to [$TP(2)_7$], the (n,m)-th display element 10 is, in principle, in the non-light emitting state. As shown in FIG. 5, time periods [$TP(2)_5$], [$TP(2)_6$], and [$TP(2)_7$] are included in the m-th horizontal scan period $H_m$.

In time periods [$TP(2)_3$] and [$TP(2)_5$], a threshold voltage cancelling process is performed to bring the potential in the other source/drain region of the drive transistor $TR_D$ toward the potential of the reference voltage $V_{Ofs}$ minus the threshold voltage of the drive transistor $TR_D$ by applying a drive voltage $V_{CC-H}$ from the power supply line PS1 to the one source/drain region of the drive transistor $TR_D$ while applying the reference voltage $V_{Ofs}$ from the data line $DTL_n$ to the gate electrode of the drive transistor $TR_D$ through the write transistor $TR_W$ that is determined to be in the conductive state on the basis of the scan signal from the scan line SCL.

In the following description, the threshold voltage cancelling process is performed over, but not limited to, a plurality of horizontal scan periods including the (m−1)-th and m-th horizontal scan periods $H_{m-1}$, $H_m$.

In time period $[TP(2)_1]$, the potential at the gate electrode of the drive transistor $TR_D$ and the potential in the other source/drain region of the drive transistor $TR_D$ are initialized by applying the initialization voltage $V_{CC-L}$ of which the different from the reference voltage $V_{Ofs}$ exceeds the threshold voltage of the drive transistor $TR_D$, from the power supply line PS1 to the one source/drain region of the drive transistor $TR_D$ and applying the reference voltage $V_{Ofs}$ from the data line $DTL_n$ to the gate electrode of the drive transistor $TR_D$ through the write transistor $TR_W$ that is determined to be in the conductive state on the basis of the scan signal from the scan line $SCL_m$.

In FIG. 5, it is assumed that time period $[TP(2)_1]$ coincides with the reference voltage time period (i.e., time period in which the reference voltage $V_{Ofs}$ is applied to the data line DTL) in the (m−2)-th horizontal scan period $H_{m-2}$, time period $[TP(2)_3]$ coincides with the reference voltage time period in the (m−1)-th horizontal scan period $H_{m-1}$, and time period $[TP(2)_5]$ coincides with the reference voltage time period in the m-th horizontal scan period $H_m$.

Referring again to FIG. 5 and so on, operations in each of time periods $[TP(2)_0]$ to $[TP(2)_8]$ will be described.

Time period $[TP(2)_0]$ (see FIGS. 5 and 17B):

The operation in time period $[TP(2)_0]$ is the operation from the previous display frame to the current display frame, for example. More specifically, time period $[TP(2)_0]$ is the time period from the beginning of the (m+m')-th horizontal scan period $H_{m+m}$ in the previous display frame to the end of the (m−3)-th horizontal scan period in the current display frame. In this time period $[TP(2)_0]$, the (n,m)-th display element 10 is, in principle, in the non-light emitting state. At the beginning of time period $[TP(2)_0]$, the voltage supplied from the power supply unit 100 to the power supply line $PS1_m$ is changed from drive voltage $V_{CC-H}$ to initialization voltage $V_{CC-L}$. Consequently, the potential in the second node $ND_2$ drops to $V_{CC-L}$, and a reverse voltage is applied between the anode electrode and the cathode electrode in the light emitting unit ELP, which brings the light emitting unit ELP into the non-light emitting state. As the potential lowers in the second node $ND_2$, the potential lowers in the floating first node $ND_1$ (gate electrode of the drive transistor $TR_D$).

Time period $[TP(2)_1]$ (see FIG. 5 and FIG. 18A):

The (m−2)-th horizontal scan period $H_{m-2}$ starts in the current display frame. In time period $[TP(2)_1]$, the scan line $SCL_m$ is brought into high level and the write transistor $TR_W$ in the display element 10 is brought into the conductive state. A reference voltage $V_{Ofs}$ is supplied from the signal output unit 102 to the data line $DTL_n$. Consequently, the potential in the first node $ND_1$ becomes $V_{Ofs}$ (0 volts). Since the initialization voltage $V_{CC-L}$ is being applied from the power supply line $PS1_m$ to the second node $ND_2$ on the basis of the operation of the power supply unit 100, the potential in the second node $ND_2$ is kept at $V_{CC-L}$ (−10 volts).

Since the potential difference between the first and second nodes $ND_1$, $ND_2$ is 10 volts and the threshold voltage $V_{th}$ of the drive transistor $TR_D$ is 3 volts, the drive transistor $TR_D$ is in the conductive state. The potential difference between the second node $ND_2$ and the cathode electrode provided in the light emitting unit ELP is −10 volts and does not exceed the threshold voltage $V_{th-EL}$ of the light emitting unit ELP. This initializes the potentials in the first and second nodes $ND_1$, $ND_2$.

Time period $[TP(2)_2]$ (see FIGS. 5 and 18B):

In time period $[TP(2)_2]$, the scan line $SCL_m$ is brought into low level. The write transistor $TR_W$ in the display element 10 is brought into the non-conductive state. The potentials in the first and second nodes $ND_1$, $ND_2$ remain, in principle, the same as in the previous states.

Time period $[TP(2)_3]$ (see FIGS. 5 and 19A):

In time period $[TP(2)_3]$, a first threshold voltage cancelling process is performed. A scan line $SCL_m$ is brought into high level and the write transistor $TR_W$ in the display element 10 is brought into the conductive state. A reference voltage $V_{Ofs}$ is supplied from the signal output unit 102 to the data line $DTL_n$. The potential in the first node $ND_1$ is $V_{Ofs}$ (0 volts).

Next, the voltage supplied from the power supply unit 100 to the power supply line $PS1_m$ is changed from voltage $V_{CC-L}$ to drive voltage $V_{CC-H}$. Consequently, although the potential in the first node $ND_1$ does not change ($V_{Ofs}$ is kept at 0 volts), the potential in the second node $ND_2$ changes toward a value of the reference voltage $V_{Ofs}$ minus the threshold voltage $V_{th}$ of the drive transistor $TR_D$. This raises the potential in the second node $ND_2$.

If time period $[TP(2)_3]$ is sufficiently long, the potential difference between the gate electrode in the drive transistor $TR_D$ and the other source/drain region reaches $V_{th}$ and the drive transistor $TR_D$ is brought into the non-conductive state. That is, the potential in the second node $ND_2$ becomes close to $(V_{Ofs}-V_{th})$ and finally reaches $(V_{Ofs}-V_{th})$. In the example shown in FIG. 5, however, since the length of time period $[TP(2)_3]$ is not enough to sufficiently change the potential in the second node $ND_2$, the potential in the second node $ND_2$ reaches a potential $V_1$ that satisfies the relationship $V_{CC-L}<V_1<(V_{Ofs}-V_{th})$ at the end of time period $[TP(2)_3]$.

Time period $[TP(2)_4]$ (see FIGS. 5 and 19B):

In time period $[TP(2)_4]$, the scan line $SCL_m$ is brought into low level and the write transistor $TR_W$ in the display element 10 is brought into the non-conductive state. Consequently, the first node $ND_1$ is brought into a floating state.

Since the drive voltage $V_{CC-H}$ is applied from the power supply unit 100 to the one source/drain region of the drive transistor $TR_D$, the potential in the second node $ND_2$ rises from potential $V_1$ to potential $V_2$. On the other hand, due to the gate electrode of the drive transistor $TR_D$ being in the floating state and the presence of capacitor $C_1$, a bootstrap operation takes place at the gate electrode of the drive transistor $TR_D$. Consequently, the potential in the first node $ND_1$ rises as the potential in the second node $ND_2$ changes.

For the operation in the next time period $[TP(2)_5]$, it is necessary that the potential in the second node $ND_2$ is lower than $(V_{Ofs}-V_{th})$ at the beginning of time period $[TP(2)_5]$. The length of time period $[TP(2)_4]$ is determined, in principle, so as to satisfy the condition $V_2<(V_{Ofs-L}-V_{th})$.

Time period $[TP(2)_5]$ (see FIGS. 5, 20A, and 20B):

In time period $[TP(2)_5]$, a second threshold voltage cancelling process is performed. The write transistor $TR_W$ in the display element 10 is brought into a conductive state on the basis of a scan signal from the scan line $SCL_m$. A reference voltage $V_{Ofs}$ is supplied from the signal output unit 102 to the data line $DTL_n$. The potential in the first node $ND_1$ returns from the potential raised by the bootstrap operation to $V_{Ofs}$ (0 volts) (see FIG. 20A).

Here, value $c_1$ is the value of the capacitor $C_1$ and value $c_{EL}$ is the value of the capacitor $C_{EL}$ in the light emitting unit ELP. Value $c_{gs}$ is the value of the parasitic capacitance between the gate electrode of the drive transistor $TR_D$ and the other source/drain region. When reference character $c_A$ denotes the capacitance value between the first and second nodes $ND_1$, $ND_2$, the relationship $c_A=c_1+c_{gs}$ is established. When reference character $C_B$ denotes the capacitance value between the second node $ND_2$ and second power supply line PS2, the relationship $c_B=c_{EL}$ is established. Additional capacitors may be connected in parallel to both ends of the light emitting unit ELP, in which case the capacitance values of the additional capacitors are added to $c_B$.

As the potential in the first node $ND_1$ changes, the potential between the first and second nodes $ND_1$, $ND_2$ changes. More specifically, the electric charge based on the quantity of potential change in the first node $ND_1$ is distributed depending on the capacitance value between the first and second nodes $ND_1$, $ND_2$ and the capacitance value between the second node $ND_2$ and the second power supply line PS2. If the value $c_b$ ($=c_{EL}$) is sufficiently high compared with the value $c_A$ ($=c_1+c_{gs}$), the change in potential in the second node $ND_2$ is small. Typically, the value $c_{EL}$ of the capacitor $C_{EL}$ in the light emitting unit ELP is greater than the value $c_1$ of the capacitor $C_1$ and the value $c_{gs}$ of the parasitic capacitance of the drive transistor $TR_D$. In the following description, the change in potential in the second node $ND_2$ due to the change in potential in the first node $ND_1$ will not be taken into account. In the drive timing chart shown in FIG. 5, the change in potential in the second node $ND_2$ due to the change in potential in the first node $ND_1$ is not taken into account.

Since the drive voltage $V_{CC-H}$ is being applied from the power supply unit 100 to the one source/drain region of the drive transistor $TR_D$, the potential in the second node $ND_2$ changes toward a value of the reference voltage $V_{Ofs}$ minus the threshold voltage $V_{th}$ of the drive transistor $TR_D$. More specifically, the potential in the second node $ND_2$ rises from the potential $V_2$ and changes toward a value of the reference voltage $V_{Ofs}$ minus the threshold voltage $V_{th}$ of the drive transistor $TR_D$. When the difference in potential between the gate electrode of the drive transistor $TR_D$ and the other source/drain region reaches $V_{th}$, the drive transistor $TR_D$ is brought into the non-conductive state (see FIG. 20B). In this state, the potential in the second node $ND_2$ is approximately $(V_{Ofs}-V_{th})$. Here, if formula (3) below is assured, i.e., if the potential is selected and determined such that formula (3) is satisfied, the light emitting unit ELP does not emit light.

$$(V_{Ofs}-V_{th})<(V_{th\text{-}EL}+V_{Cat}) \tag{3}$$

In time period $[TP(2)_5]$, the potential in the second node $ND_2$ finally reaches $(V_{Ofs}-V_{th})$. More specifically, the potential in the second node $ND_2$ only depends on the threshold voltage $V_{th}$ in the drive transistor $TR_D$ and the reference voltage $V_{Ofs}$. It does not depend on the threshold voltage $V_{th\text{-}EL}$ of the light emitting unit ELP. At the end of time period $[TP(2)_5]$, the write transistor $TR_W$ in the conductive state is brought into the non-conductive state on the basis of the scan signal from the scan line $SCL_m$.

Time period $[TP(2)_6]$ (see FIGS. 5 and 21A):

A video signal voltage $V_{Sig_n}$, instead of the reference voltage $V_{Ofs}$, is supplied from the signal output unit 102 to an end of the data line $DTL_n$ while the write transistor $TR_W$ is kept in the non-conductive state. In time period $[TP(2)_5]$, if the drive transistor $TR_D$ is already in the non-conductive state, the potentials in the first and second nodes $ND_1$, $ND_2$ virtually do not change (the potentials may actually change due to the capacitive coupling of parasitic capacitance etc. but these changes are negligible). If the drive transistor $TR_D$ has not become non-conductive in the threshold voltage cancelling process performed in time period $[TP(2)_5]$, a bootstrap operation takes place in time period $[TP(2)_6]$, which slightly raises the potentials in the first and second nodes $ND_1$, $ND_2$.

Time period $[TP(2)_7]$ (see FIGS. 5 and 21B):

In time period $[TP(2)_7]$, the write transistor $TR_W$ in the display element 10 is brought into the conductive state on the basis of the scan signal on the scan line $SCL_m$. A video signal voltage $V_{Sig_m}$ is applied from the data line $DTL_n$ to the gate electrode of the write transistor $TR_W$.

In the write operation described above, a video signal voltage $V_{Sig}$ is applied to the gate electrode of the drive transistor $TR_D$ while the drive voltage $V_{CC-H}$ is being applied from the power supply unit 100 to the one source/drain region of the drive transistor $TR_D$. This changes the potential in the second node $ND_2$ in the display element 10 in time period $[TP(2)_7]$ as shown in FIG. 5. Specifically, the potential of the second node $ND_2$ rises. The quantity of this potential rise is denoted by reference character $\Delta V$.

If the potential rise in the second node $ND_2$ is not taken into account, the values of $V_g$ and $V_s$ become as follows, where $V_g$ is the potential at the gate electrode (first node $ND_1$) of the drive transistor $TR_D$ and $V_s$ is the potential in the other source/drain region (second node $ND_2$) of the drive transistor $TR_D$. The difference in potential between the first and second nodes $ND_1$, $ND_2$, i.e., the potential difference $V_{gs}$ between the gate electrode of the drive transistor $TR_D$ and the other source/drain region serving as the source region, can be expressed by formula (4) below:

$$V_g=V_{Sig_m}$$

$$V_s\approx V_{Ofs}-V_{th}$$

$$V_{gs}\approx V_{Sig_m}-(V_{Ofs}-V_{th}) \tag{4}$$

More specifically, the $V_{gs}$ obtained in the write operation to the drive transistor $TR_D$ depends only on the video signal voltage $V_{Sig_m}$ for controlling the luminance in the light emitting unit ELP, the threshold voltage $V_{th}$ of the drive transistor $TR_D$, and the reference voltage $V_{Ofs}$. It does not depend on the threshold voltage $V_{th\text{-}EL}$ of the light emitting unit ELP.

Next, the quantity of potential rise ($\Delta V$) in the second node $ND_2$ will be described. In the driving method described above, the write operation is performed while the drive voltage $V_{CC-H}$ is being applied to the one source/drain region of the drive transistor $TR_D$ in the display element 10. With this, a mobility correction process is also performed to change the potential in the other source/drain region of the drive transistor $TR_D$ in the display element 10.

If the drive transistors $TR_D$ are manufactured from thin film transistors or the like, mobility $\mu$ would inevitably vary among the transistors. Even if video signal voltages $V_{Sig}$ having the same value are applied to the gate electrodes of a plurality of drive transistors $TR_D$ having different mobilities $\mu$, the drain current $I_{ds}$ flowing through a drive transistor $TR_D$ with a higher mobility $\mu$ would differ from the drain current $I_{ds}$ flowing through a drive transistor $TR_D$ with a lower mobility $\mu$. Such a difference, if any, will impair the uniformity on the screen of the display device 1.

In the driving method described above, the video signal voltage $V_{Sig}$ is applied to the gate electrode of the drive transistor $TR_D$ while the drive voltage $V_{CC-H}$ is being applied from the power supply unit 100 to the one source/drain region of the drive transistor $TR_D$. Consequently, the potential in the second node $ND_2$ rises during the write operation as shown in FIG. 5. If the value of mobility μ of the drive transistor $TR_D$ is high, the quantity of potential rise ΔV (potential correction value) in the other source/drain region of the drive transistor $TR_D$ (i.e., potential in the second node $ND_2$) is large. In contrast, if the value of mobility μ of the drive transistor $TR_D$ is low, the quantity of potential rise ΔV in the other source/drain region of the drive transistor $TR_D$ is small. Here, the potential difference $V_{gs}$ between the gate electrode of the drive transistor $TR_D$ and the other source/drain region serving as the source region is converted from formula (4) to formula (5) below:

$$V_{gs} \approx V_{Sig_m} - (V_{Ofs} - V_{th}) - \Delta V \quad (5)$$

The length of duration of the scan signal for writing the video signal voltage $V_{Sig}$ may be determined depending on the design of the display element 10 and/or display device 1. It is assumed here that the duration of the scan signal is determined such that the potential ($V_{Ofs}-V_{th}+\Delta V$) in the other source/drain region of the drive transistor $TR_D$ satisfies formula (3') below.

In the display element 10, the light emitting unit ELP does not emit light during time period $[TP(2)_7]$. This mobility correction process also corrects the variations of coefficient $k\cdot(\equiv(1/2)\cdot(W/L)\cdot C_{ox})$.

$$(V_{Ofs} - V_{th} + \Delta V) < (V_{th\text{-}EL} + V_{Cat}) \quad (3')$$

Time period $[TP(2)_8]$ (see FIGS. 5 and 22)]:

The one source/drain region of the drive transistor $TR_D$ is kept in the state in which the drive voltage $V_{CC\text{-}H}$ is being supplied from the supply unit 100. In the display element 10, a voltage dependent on the video signal voltage $V_{Sig_m}$ is kept in the capacitor $C_1$ by the write operation. Since the scan signal from the scan line has ceased, the write transistor $TR_W$ is brought into the non-conductive state. Consequently, the application of the video signal voltage $V_{Sig_m}$ to the gate electrode of the drive transistor $TR_D$ ceases and a current dependent on the value of the voltage kept in the capacitor $C_1$ by the write operation flows through the drive transistor $TR_D$ into the light emitting unit ELP, which causes the light emitting unit ELP to emit light.

The operation of the display element 10 will now be described in more detail. The one source/drain region of the drive transistor $TR_D$ is kept in a state in which the drive voltage $V_{CC\text{-}H}$ is being applied from the power supply unit 100, and the first node $ND_1$ is electrically disconnected from the data line $DTL_n$. Consequently, the potential in the second node $ND_2$ rises.

Here, due to the gate electrode of the drive transistor $TR_D$ being in a floating state and the presence of the capacitor $C_1$, a phenomenon similar to that in the so-called bootstrap circuit arises in the gate electrode of the drive transistor $TR_D$ and the potential in the first node $ND_1$ also rises, as described above. Consequently, the potential difference $V_{gs}$ between the gate electrode of the drive transistor $TR_D$ and the other source/drain region serving as the source region retains the value in formula (5).

Since the potential in the second node $ND_2$ rises and exceeds ($V_{th\text{-}EL}+V_{Cat}$), the light emitting unit ELP starts emitting light. The current flowing into the light emitting unit ELP, which is the drain current $I_{ds}$ flowing from the drain region of the drive transistor $TR_D$ to the source region, can be expressed by formula (1). Here, from formulae (1) and (5), the formula (1) can be converted to formula (6):

$$I_{ds} = k\cdot\mu\cdot(V_{Sig_m} - V_{Ofs} - \Delta V)^2 \quad (6)$$

Accordingly, if the reference voltage $V_{Ofs}$ is set to 0 volts, the current $I_{ds}$ flowing into the light emitting unit ELP is proportional to the square of the value of the video signal voltage $V_{Sig_m}$ for controlling the luminance in the light emitting unit ELP minus the value of the potential correction value ΔV due to the mobility μ of the drive transistor $TR_D$. In other words, the current $I_{ds}$ flowing into the light emitting unit ELP does not depend on the threshold voltage $V_{th\text{-}EL}$ of the light emitting unit ELP and the threshold voltage $V_{th}$ of the drive transistor $TR_D$. More specifically, the quantity of light (i.e., luminance) emitted by the light emitting unit ELP is not influenced by the threshold voltage $V_{th\text{-}EL}$ of the light emitting unit ELP and the threshold voltage $V_{th}$ of the drive transistor $TR_D$. The luminance of the display element 10 forming the (n,m)-th pixel is a value corresponding to the current $I_{ds}$.

As the drive transistor $TR_D$ has a higher mobility the potential correction value ΔV becomes higher and consequently the value $V_{gs}$ on the left side of formula (5) becomes smaller. Accordingly, since the value $(V_{Sig_m}-V_{Ofs}-\Delta V)^2$ becomes small despite a large value of mobility μ in formula (6), variations in drain current $I_{ds}$ due to the variations in mobility μ of the drive transistors $TR_D$ (and the variations in k) can be corrected. In this manner, variations in luminance of the light emitting units ELP due to the variations in mobility μ (and the variations in k) can be corrected.

The light emitting state of the light emitting unit ELP continues until the (m+m'−1)-th horizontal scan period. The end of the (m+m'−1)-th horizontal scan period corresponds to the end of time period $[TP(2)_{-1}]$. Here, "m'" satisfies the relationship 1<m'<M and is a predetermined value in the display device 1. In other words, the light emitting unit ELP is driven and emits light during a time period from the beginning of time period $[TP(2)_8]$ until immediately before the (m+m')-th horizontal scan period $H_{m+m'}$.

The embodiment of the present disclosure has been specifically described, but the present disclosure is not limited to the embodiment described above; variations can be made on the basis of the technical idea of the present disclosure. For example, the numerical values, structures, substrates, materials, processes, etc. mentioned in the embodiment described above are only illustrative; different numerical values, structures, substrates, materials, processes, etc. may be used if necessary.

Figure 23:
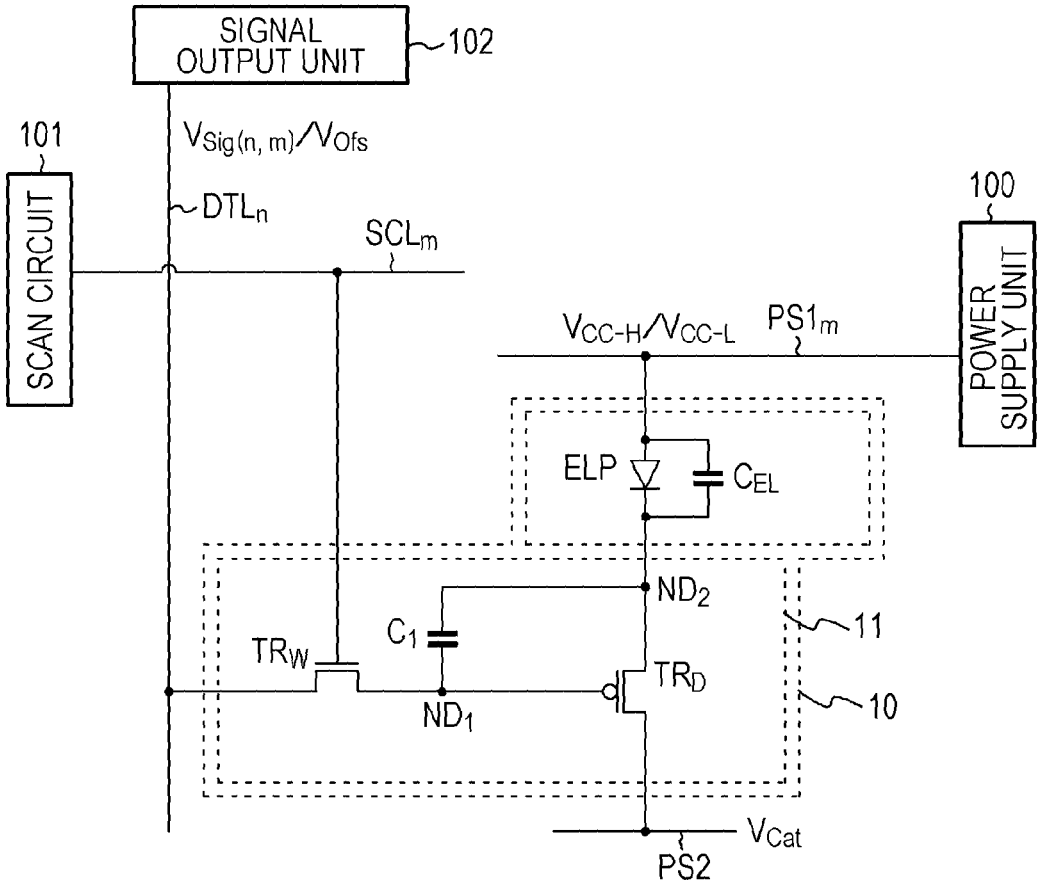
FIG. 23 is a schematic circuit diagram illustrating another exemplary drive circuit forming part of a display element.

If the drive transistor is a p-channel transistor, for example, the connection between the drive transistor and the light emitting unit ELP may be changed as in FIG. 23. In this circuit, the threshold voltage cancelling process, write operation, and bootstrap operation can be performed with no problem.

Figure 24:
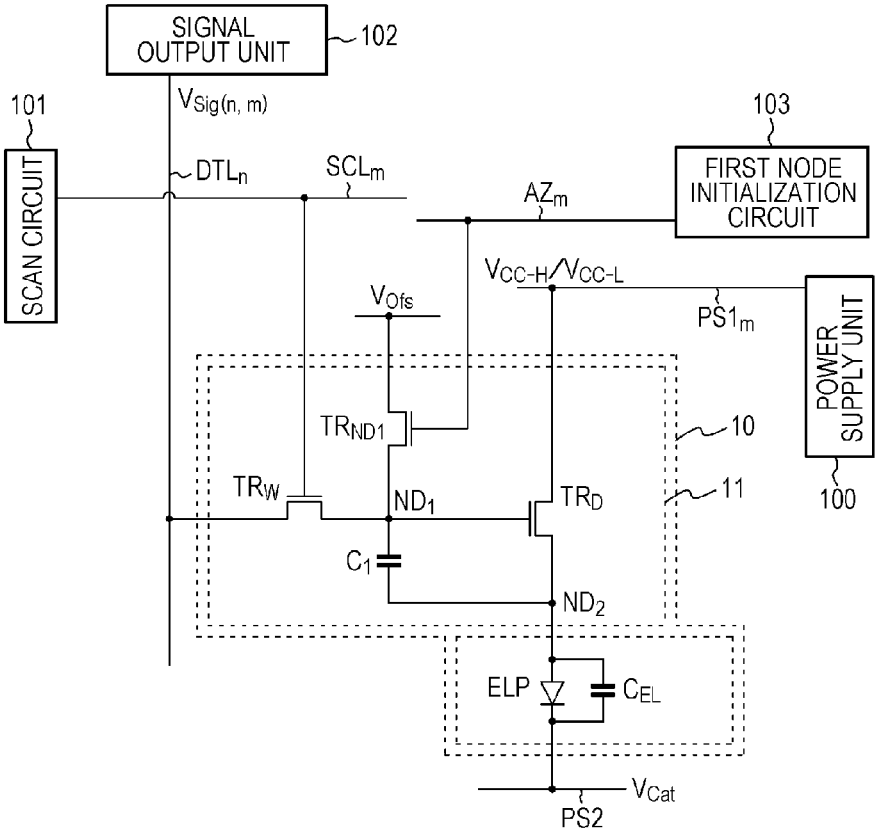
FIG. 24 is a schematic circuit diagram illustrating another exemplary drive circuit forming part of a display element.

Alternatively, the drive circuit 11 forming part of the display element 10 may include a first node initializing transistor $TR_{ND1}$ connected to the first node $ND_1$ as shown in FIG. 24. In the first node initializing transistor $TR_{ND1}$, a reference voltage $V_{Ofs}$ is applied to one source/drain region and the other source/drain region is connected to the first node $ND_1$. Signals from the first node initialization circuit 103 are applied through a line AZ to the gate electrode of the first node initializing transistor $TR_{ND1}$ to control the on/off state of the first node initializing transistor $TR_{ND1}$. In this manner, the potential in the first node $ND_1$ can be set.

The technology of the present disclosure can take the following configuration:

[1]

A display device including a display unit having display elements arrayed in rows and columns of a two-dimensional matrix, the display elements each including a current-driven light emitting unit and a drive circuit for driving the light emitting unit; a power supply unit for supplying a drive voltage for driving the display elements to power supply lines arranged in correspondence with the rows of display elements; a signal output unit for supplying video signal voltages dependent on video signal values to data lines provided in correspondence with the columns of display elements; and a control unit for detecting maximum grayscale values of input signals corresponding to the display elements arranged in rows on the basis of the input signals for an image to be displayed, then, on the basis of the detection result, controlling the duty ratios of the drive voltage supplied to the power supply lines corresponding to the rows of display elements, and controlling the values of video signals corresponding to the display elements in each row on the basis of the duty ratios of the drive voltage and the input signals.

[2]

The display device according to item [1] above, wherein the video signal values corresponding to the values of the duty ratios of the drive voltage and the values of the input signals are set so as to compensate for an influence of the length of time elapsed before the light emitting unit starts emitting light that varies with the value of the current flowing into the light emitting unit.

[3]

The display device according to item [1] or [2] above, wherein the control unit includes a video signal value table storage unit in which the values of the video signals corresponding to the values of duty ratios of the drive voltage and the values of the input signals are stored.

[4]

The display device according to any of items [1] to [3] above, wherein the control unit sets the duty ratios of the drive voltage to a predetermined value $D_1$ when the maximum grayscale value is equal to or less than a predetermined reference value, or to a predetermined value $D_2$ greater than the value $D_1$ when the maximum grayscale value exceeds the predetermined reference value.

[5]

The display device according to item [4] above, wherein, if the vicinity of the row having the maximum grayscale value exceeding the predetermined reference value is occupied by rows having the maximum grayscale values not exceeding the predetermined reference value, the control unit controls the duty ratios of the drive voltage in the rows adjacent to the row having the maximum grayscale value exceeding the predetermined reference value such that the duty ratios in the adjacent rows closer to the row having the maximum grayscale value exceeding the predetermined reference value become closer to the predetermined value $D_2$ and controls the values of the video signals corresponding to the display elements.

[6]

A method of driving a display device, the display device including a display unit having display elements arrayed in rows and columns of a two-dimensional matrix, the display elements each including a current-driven light emitting unit and a drive circuit for driving the light emitting unit; a power supply unit for supplying a drive voltage for driving the display elements to power supply lines provided in correspondence with the rows of display elements; a signal output unit for supplying video signal voltages dependent on the video signals to data lines provided in correspondence with the columns of display elements; and a control unit for controlling the duty ratios of the drive voltage supplied to the power supply lines provided in correspondence with the rows of display elements and for controlling the values of the video signals corresponding to the display elements; includes detecting maximum grayscale values of input signals corresponding to the display elements arranged in rows on the basis of the input signals for an image to be displayed; controlling, on the basis of the detection result, duty ratios of a drive voltage supplied to the power supply lines corresponding to the display elements; and controlling the values of the video signals corresponding to the display elements in each row on the basis of the duty ratios of the drive voltage and the input signals.

[7]

The method of driving the display device according to item [6] above, wherein the video signal values corresponding to the values of the duty ratios of the drive voltage and the values of the input signals are set so as to compensate for an influence of the length of time elapsed before the light emitting unit starts emitting light that varies with the value of the current flowing into the light emitting unit.

[8]

The method of driving the display device according to item [6] or [7] above, wherein the control unit includes a video signal value table storage unit in which the values of the video signals corresponding to the values of the duty ratios of the drive voltage and the values of the input signals are stored.

[9]

The method of driving the display device according to any of items [6] to [8] above, wherein the control unit sets the duty ratios of the drive voltage to a predetermined value $D_1$ when the maximum grayscale value is equal to or less than a predetermined reference value, or to a predetermined value $D_2$ greater than the value $D_1$ when the maximum grayscale value exceeds the predetermined reference value.

[10]

The method of driving the display device according to item [9] above, wherein, if the vicinity of the row having the maximum grayscale value exceeding the predetermined reference value is occupied by rows having the maximum grayscale values not exceeding the predetermined reference value, the control unit controls the duty ratios of the drive voltage in the rows adjacent to the row having the maximum grayscale value exceeding the predetermined reference value such that the duty ratios in the adjacent rows closer to the row having the maximum grayscale value exceeding the predetermined reference value become closer to the predetermined value $D_2$ and controls the video signal values corresponding to the display elements.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display unit having display elements arrayed in rows and columns of a two-dimensional matrix, the display elements each including a current-driven light emitting unit and a drive circuit for driving the current-driven light emitting unit;

a power supply unit for supplying a drive voltage for driving the display elements to power supply lines provided in correspondence with the rows of the display elements;

a signal output unit for supplying video signal voltages dependent on video signal values to data lines provided in correspondence with the columns of the display elements; and a control unit for detecting maximum grayscale values of input signals corresponding to the display elements arranged in the rows on a basis of the input signals for an image to be displayed, then, on a basis of a detection result, controlling duty ratios of the drive voltage supplied to the power supply lines provided in correspondence with the rows of the display elements, and controlling the video signal values corresponding to the display elements in each of the rows on a basis of the duty ratios of the drive voltage and the input signals, wherein the control unit sets the duty ratios of the drive voltage to a predetermined value $D_1$ when the maximum grayscale value is equal to or less than a predetermined reference value, or to a predetermined value $D_2$ greater than the predetermined value $D_1$ when the maximum grayscale value exceeds the predetermined reference value, and if a vicinity of a row having the maximum grayscale value exceeding the predetermined reference value is occupied by rows having the maximum grayscale values not exceeding the predetermined reference value, the control unit controls the duty ratios of the drive voltage in the rows in the vicinity of the row having the maximum grayscale value exceeding the predetermined reference value such that the duty ratios in rows closer to the row having the maximum grayscale value exceeding the predetermined reference value become closer to the predetermined value $D_2$ and controls the video signal values corresponding to the display elements.

2. The display device according to claim 1, wherein the video signal values corresponding to values of the duty ratios of the drive voltage and values of the input signals are set so as to compensate for an influence of a length of time elapsed before the current-driven light emitting unit starts emitting light that varies with a value of a current flowing into the current-driven light emitting unit.

3. The display device according to claim 1, wherein the control unit includes a video signal value table storage unit in which values of video signals corresponding to values of the duty ratios of the drive voltage and values of the input signals are stored.

4. A method of driving a display device, the display device including:

a display unit including display elements arrayed in rows and columns of a two-dimensional matrix, the display elements each including a current-driven light emitting unit and a drive circuit for driving the current-driven light emitting unit;

a power supply unit for supplying a drive voltage for driving the display elements to power supply lines provided in correspondence with the rows of the display elements;

a signal output unit for supplying video signal voltages dependent on video signal values to data lines provided in correspondence with the columns of the display elements; and a control unit for controlling duty ratios of the drive voltage supplied to the power supply lines provided in correspondence with the rows of the display elements and for controlling the video signal values corresponding to the display elements;

the method comprising:

detecting maximum grayscale values of input signals corresponding to the display elements arranged in the rows on a basis of the input signals for an image to be displayed;

controlling, on a basis of a detection result, the duty ratios of the drive voltage supplied to the power supply lines provided in correspondence with the rows of the display elements; and controlling the video signal values corresponding to the display elements in each of the rows on a basis of the duty ratios of the drive voltage and the input signals, wherein the controlling the duty ratios includes:

setting the duty ratios of the drive voltage to a predetermined value $D_1$ when the maximum grayscale value is equal to or less than a predetermined reference value, or to a predetermined value $D_2$ greater than the predetermined value $D_1$ when the maximum grayscale value exceeds the predetermined reference value, and if a vicinity of a row having the maximum grayscale value exceeding the predetermined reference value is occupied by rows having the maximum grayscale values not exceeding the predetermined reference value, controlling the duty ratios of the drive voltage in the rows in the vicinity of the row having the maximum grayscale value exceeding the predetermined reference value such that the duty ratios in rows closer to the row having the maximum grayscale value exceeding the predetermined reference value become closer to the predetermined value $D_2$.

* * * * *